US010730087B2

(12) United States Patent
Yamashita

(10) Patent No.: US 10,730,087 B2
(45) **Date of Patent: *Aug. 4, 2020**

(54) METHOD FOR PRODUCING H-SHAPED STEEL AND H-SHAPED STEEL PRODUCT

(71) Applicant: NIPPON STEEL CORPORATION, Tokyo (JP)

(72) Inventor: Hiroshi Yamashita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 99 days.

This patent is subject to a terminal disclaimer.

(21) Appl. No.: 15/559,373

(22) PCT Filed: Mar. 10, 2016

(86) PCT No.: PCT/JP2016/057631

§ 371 (c)(1),
(2) Date: Sep. 18, 2017

(87) PCT Pub. No.: WO2016/148028

PCT Pub. Date: Sep. 22, 2016

(65) Prior Publication Data

US 2018/0071801 A1 Mar. 15, 2018

(30) Foreign Application Priority Data

Mar. 19, 2015 (JP) ..... 2015-056632
Mar. 19, 2015 (JP) ..... 2015-056634
Mar. 19, 2015 (JP) ..... 2015-056650

(51) Int. Cl.
*B21B 1/088* (2006.01)
*B21B 27/02* (2006.01)
*B21B 1/02* (2006.01)

(52) U.S. Cl.
CPC ..... *B21B 1/0886* (2013.01); *B21B 1/026* (2013.01); *B21B 1/088* (2013.01); *B21B 27/02* (2013.01);
(Continued)

(58) Field of Classification Search
CPC ..... B21B 1/0886; B21B 1/026; B21B 27/02; B21B 1/088; B21B 2261/02; B21B 2001/028
See application file for complete search history.

(56) References Cited

U.S. PATENT DOCUMENTS 4,402,206 A * 9/1983 Yanazawa ..... D06M 15/673 72/221
4,420,961 A * 12/1983 Kusaba ..... B21B 1/088 72/221
(Continued)

FOREIGN PATENT DOCUMENTS

CN 1745917 A 3/2006
CN 201070634 Y 6/2008
(Continued)

OTHER PUBLICATIONS

Extended European Search Report, dated Nov. 9, 2018, for corresponding European Application No. 16764858.3.
(Continued)

*Primary Examiner* — Ryan J. Walters
(74) *Attorney, Agent, or Firm* — Birch, Stewart, Kolasch & Birch, LLP

(57) ABSTRACT

[Object] To produce an H-shaped steel product with a flange width larger than a conventional flange width by, in a rough rolling step using calibers in producing H-shaped steel, creating deep splits on end surfaces of a material (e.g., slab) using projections with acute-angle tip shapes, and sequentially bending flange portions formed by the splits.
(Continued)

[Solution] Provided is a method for producing H-shaped steel using a slab as a material. In a rolling mill that performs a rough rolling step, a plurality of calibers to shape a material to be rolled, and a web thinning caliber to thin a web of the material to be rolled that has been shaped in the plurality of calibers are engraved, the number of the plurality of calibers being three or more. Shaping of a plurality of passes is performed on the material to be rolled in part or all of the plurality of calibers. In a first caliber and a second caliber among the plurality of calibers, projections to create splits vertically with respect to a width direction of the material to be rolled are formed. In a third caliber and subsequent calibers among the plurality of calibers, a step of sequentially bending divided parts formed by the splits is performed. The projections formed in the first caliber and the second caliber have a tip angle of 40° or less.

13 Claims, 13 Drawing Sheets

(52) U.S. Cl.
CPC ..... *B21B 2001/028* (2013.01); *B21B 2261/02* (2013.01)

(56) References Cited

U.S. PATENT DOCUMENTS

| | | | | |
|---|---|---|---|---|
| 4,637,241 | A * | 1/1987 | Michaux | B21B 1/088 72/225 |
| 5,009,094 | A * | 4/1991 | Hayashi | B21B 1/088 72/225 |
| 2018/0071801 | A1 | 3/2018 | Yamashita | |
| 2018/0111178 | A1* | 4/2018 | Yamashita | B21B 1/088 |

FOREIGN PATENT DOCUMENTS

| | | | |
|---|---|---|---|
| CN | 202762723 | U | 3/2013 |
| CN | 103056160 | A | 4/2013 |
| JP | 52-20958 | A | 2/1977 |
| JP | 58-188501 | A | 11/1983 |
| JP | 60-21101 | A | 2/1985 |
| JP | 7-88501 | A | 4/1995 |
| JP | 7-164003 | A | 6/1995 |
| JP | 7-178404 | A | 7/1995 |
| JP | 11-347601 | A | 12/1999 |
| JP | 2000-246304 | A | 9/2000 |
| JP | 2002-45902 | A | 2/2002 |
| JP | 2004-358541 | A | 12/2004 |
| JP | 2013-43186 | A | 3/2013 |

OTHER PUBLICATIONS

Japanese Office Action, dated Nov. 6, 2018, for corresponding Japanese Application No. 2017-506504, with an English translation.
International Search Report for PCT/JP2016/057631 (PCT/ISA/210) dated Apr. 12, 2016.
Kenchikuyo Shizai Handbook, Nippon Steel & Sumitomo Metal Corporation, [online], Aug. 2014, [retrieval date Mar. 31, 2016], Internet:<URL:http://www.nssmc.com/product/catalog_download/pdf/E001.pdf>, pp. 152, 153.
Written Opinion of the International Searching Authority for PCT/JP2016/057631 (PCT/ISA/237) dated Apr. 12, 2016.
Chinese Office Action and Search Report, dated Jul. 12, 2018, for corresponding Chinese Application No. 201680016843.8, with an English translation of the Office Action.
Chinese Office Action and Search Report for Chinese Application No. 201680016996.2, dated Jul. 3, 2018, with partial English translation.
Extended European Search Report dated Nov. 13, 2018, for European Application No. 16764860.9.
International Search Report for PCT/JP2016/057647 dated Apr. 12, 2016, with English translation.
Japanese Office Action, dated Oct. 30, 2018, for Japanese Application No. 2017-506506, along with a Partial English translation.
U.S. Office Action dated Jul. 30, 2019, for U.S. Appl. No. 15/559,310.
Written Opinion of the International Searching Authority for PCT/JP2016/057647 (PCT/ISA/237) dated Apr. 12, 2016.
U.S. Office Action dated Jan. 17, 2020, for U.S. Appl. No. 15/559,310.
Notice of Allowance dated Apr. 1, 2020 for U.S. Appl. No. 15/559,310.

* cited by examiner

METHOD FOR PRODUCING H-SHAPED STEEL AND H-SHAPED STEEL PRODUCT

CROSS REFERENCE TO RELATED APPLICATIONS

This application claims the benefit of Japanese Priority Patent Application JP 2015-056632, Japanese Priority Patent Application JP 2015-056634, and Japanese Priority Patent Application JP 2015-056650 filed Mar. 19, 2015, the entire contents of each of which are incorporated herein by reference.

TECHNICAL FIELD

The present invention relates to a method for producing H-shaped steel using a slab or the like having a rectangular cross-section as a material, for example, and a produced H-shaped steel product.

BACKGROUND ART

In the case where H-shaped steel is produced, a material, such as a slab or a bloom, extracted from a heating furnace is shaped into a raw blank (a material to be rolled with a so-called dog-bone shape) by a rough rolling mill (BD). Thicknesses of a web and flanges of the raw blank are subjected to reduction by an intermediate universal rolling mill, and moreover, flanges of a material to be rolled are subjected to width reduction and forging and shaping of end surfaces by an edger rolling mill close to the intermediate universal rolling mill. Then, an H-shaped steel product is shaped by a finishing universal rolling mill.

In such a method for producing H-shaped steel, a technology is known (e.g., see Patent Literature 1) in which, in shaping a raw blank with a so-called dog-bone shape from a slab material having a rectangular cross-section, splits are created on slab end surfaces in a first caliber of a rough rolling step, the splits are then widened or made deeper in a second caliber and subsequent calibers, and the splits on the slab end surfaces are erased in subsequent calibers.

As modification examples of the technology described above, Patent Literature 2 discloses, for example, a technology of performing shaping by applying reduction without restraining both sides of end portions of a material to be rolled (both end portions of slab end surfaces), and Patent Literature 3 discloses, for example, a technology of performing rolling using a caliber configuration in which apex angles of projections formed in calibers are not changed and heights of the projections are increased.

CITATION LIST

Patent Literature

Patent Literature 1: JP 2000-246304A
Patent Literature 2: JP H11-347601A
Patent Literature 3: JP H7-164003A

SUMMARY OF INVENTION

Technical Problem

In recent years, an increase in size of structures and the like has brought about demands for production of large-size H-shaped steel products. In particular, there have been demands for a product in which flanges, which greatly contribute to strength and rigidity of H-shaped steel, are made wider than conventional flanges. To produce an H-shaped steel product with widened flanges, it is necessary to shape a material to be rolled with a flange width larger than a conventional flange width from the stage of shaping in the rough rolling step.

However, there is a limit in widening of flanges in a method in which splits are created on end surfaces of a material such as a slab (slab end surfaces) and the end surfaces are subjected to edging, and the spread is utilized for rough rolling, as disclosed in Patent Literatures 1 to 3, for example. That is, in order to widen flanges, conventional rough rolling methods use technologies such as wedge designing (designing of a split angle), reduction adjustment, and lubrication adjustment to improve spread, but none of the methods greatly contributes to a flange width; thus, it is known that the rate of spread, which indicates the ratio of a flange spread amount with respect to an edging amount, is approximately 0.8 even under a condition in which efficiency at the initial stage of edging is the highest, decreases as edging is repeated in the same caliber, and finally becomes approximately 0.5. It may also be possible to increase the size of the material (e.g., slab) itself to increase the edging amount, but product flanges are not sufficiently widened because there are device limits in equipment scale and an amount of reduction of rough rolling mills.

In view of such circumstances, an object of the present invention is to provide a technology of producing H-shaped steel, the technology enabling production of an H-shaped steel product with a flange width larger than a conventional flange width by, in a rough rolling step using calibers in producing H-shaped steel, creating deep splits on end surfaces of a material (e.g., slab) using projections with acute-angle tip shapes, and sequentially bending flange portions formed by the splits.

Solution to Problem

According to the present invention in order to achieve the above-mentioned object, there is provided a method for producing H-shaped steel using a slab as a material, the method including: a rough rolling step; an intermediate rolling step; and a finish rolling step. In a rolling mill that performs the rough rolling step, a plurality of calibers to shape a material to be rolled, and a web thinning caliber to thin a web of the material to be rolled that has been shaped in the plurality of calibers are engraved, the number of the plurality of calibers being three or more. Shaping of a plurality of passes is performed on the material to be rolled in part or all of the plurality of calibers. In a first caliber and a second caliber among the plurality of calibers, projections to create splits vertically with respect to a width direction of the material to be rolled are formed. In a third caliber and subsequent calibers among the plurality of calibers, a step of sequentially bending divided parts formed by the splits is performed. The projections formed in the first caliber and the second caliber have a tip angle of 40° or less.

A slab width of the slab may be larger than a lower-limit slab width determined by an expression (5) below and may be smaller than an upper-limit slab width determined by an expression (6) below:

$$\text{lower-limit slab width} = (\text{product web inside dimension } U + \text{wedge height } Ah \times 2 + \text{slab thickness } t) - \text{inside-dimension widening amount } \Delta \text{ in subsequent mills} \quad (5)$$

upper-limit slab width=slab edging amount+product web inside dimension $U$+inside-dimension widening amount $\Delta$ in subsequent mills (6), where subsequent mills refer to a group of a series of rolling mills that are subsequent to the web thinning caliber and perform widening of a web inside dimension.

Shaping in the plurality of calibers may be performed under a condition that satisfies an expression (2) below:

$$h \geq H \quad (2),$$

where h denotes a flange half-width at the end of caliber shaping, and H denotes a flange half-width of an H-shaped steel product.

In the first caliber among the plurality of calibers, a caliber width of the caliber may be substantially equal to a thickness of the material to be rolled in shaping using the caliber.

In the second caliber among the plurality of calibers, shaping may be performed in a state where an end surface of the material to be rolled is out of contact with a bottom surface of the caliber.

In the plurality of calibers, shaping may be performed in a state where an end surface of the material to be rolled is out of contact with a bottom surface of the caliber.

The projections may have a tip angle of equal to or more than 25° and equal to or less than 35°.

The slab may be a slab material whose slab width/slab thickness is equal to or more than 6.0 and equal to or less than 7.7, and the projections formed in the first caliber may be designed to have a height of 100 mm or more.

The plurality of calibers may be engraved in a sizing mill.

Projections that are pressed against the divided parts to bend the divided parts may be formed in the third caliber and subsequent calibers among the plurality of calibers, and the projections formed in the second caliber and subsequent calibers may have tip angles sequentially increasing toward subsequent calibers.

According to the present invention, there is provided an H-shaped steel product produced by the method for producing H-shaped steel described above. The H-shaped steel product is shaped by using, as a material, a slab with a width of 1820 mm or less and a thickness of equal to or more than 290 mm and equal to or less than 310 mm, and the H-shaped steel product has a web height of equal to or more than 950 mm and less than 1050 mm and a flange width of equal to or more than 350 mm and less than 450 mm.

There is provided an H-shaped steel product produced by the method for producing H-shaped steel described above. The H-shaped steel product is shaped by using, as a material, a slab with a width of 1920 mm or less and a thickness of equal to or more than 290 mm and equal to or less than 310 mm, and the H-shaped steel product has a web height of equal to or more than 1050 mm and less than 1150 mm and a flange width of equal to or more than 350 mm and less than 450 mm.

There is provided an H-shaped steel product produced by the method for producing H-shaped steel described above. The H-shaped steel product is shaped by using, as a material, a slab with a width of 2020 mm or less and a thickness of equal to or more than 290 mm and equal to or less than 310 mm, and the H-shaped steel product has a web height of equal to or more than 1150 mm and less than 1250 mm and a flange width of equal to or more than 350 mm and less than 450 mm.

There is provided an H-shaped steel product produced by the method for producing H-shaped steel described above. The H-shaped steel product is shaped by using, as a material, a slab with a width of 2120 mm or less and a thickness of equal to or more than 290 mm and equal to or less than 310 mm, and the H-shaped steel product has a web height of equal to or more than 1250 mm and less than 1350 mm and a flange width of equal to or more than 350 mm and less than 450 mm.

There is provided an H-shaped steel product produced by the method for producing H-shaped steel described above. The H-shaped steel product is shaped by using, as a material, a slab with a width of 2220 mm or less and a thickness of equal to or more than 290 mm and equal to or less than 310 mm, and the H-shaped steel product has a web height of equal to or more than 1350 mm and less than 1450 mm and a flange width of equal to or more than 350 mm and less than 450 mm.

There is provided an H-shaped steel product produced by the method for producing H-shaped steel described above. The H-shaped steel product is shaped by using, as a material, a slab with a width of 2320 mm or less and a thickness of equal to or more than 290 mm and equal to or less than 310 mm, and the H-shaped steel product has a web height of equal to or more than 1450 mm and less than 1550 mm and a flange width of equal to or more than 350 mm and less than 450 mm.

There is provided an H-shaped steel product produced by the method for producing H-shaped steel described above. The H-shaped steel product is shaped by using, as a material, a slab with a width of 2420 mm or less and a thickness of equal to or more than 290 mm and equal to or less than 310 mm, and the H-shaped steel product has a web height of equal to or more than 1550 mm and less than 1650 mm and a flange width of equal to or more than 350 mm and less than 450 mm.

There is provided an H-shaped steel product produced by the method for producing H-shaped steel described above. The H-shaped steel product is shaped by using, as a material, a slab with a width of 1930 mm or less and a thickness of equal to or more than 290 mm and equal to or less than 310 mm, and the H-shaped steel product has a web height of equal to or more than 950 mm and less than 1050 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2030 mm or less and a thickness of equal to or more than 290 mm and equal to or less than 310 mm, and the H-shaped steel product has a web height of equal to or more than 1050 mm and less than 1150 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2130 mm or less and a thickness of equal to or more than 290 mm and equal to or less than 310 mm, and the H-shaped steel product has a web height of equal to or more than 1150 mm and less than 1250 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2230 mm or less and a thickness of equal to or more than 290 mm and equal to or less than 310 mm, and the H-shaped steel product has a web height of equal to or more than 1250 mm and less than 1350 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2330 mm or less and a thickness of equal to or more than 290 mm and equal to or less than 310 mm, and the H-shaped steel product has a web height of equal to or more than 1350 mm and less than 1450 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2430 mm or less and a thickness of equal to or more than 290 mm and equal to or less than 310 mm, and the H-shaped steel product has a web height of equal to or more than 1450 mm and less than 1550 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2530 mm or less and a thickness of equal to or more than 290 mm and equal to or less than 310 mm, and the H-shaped steel product has a web height of equal to or more than 1550 mm and less than 1650 mm and a flange width of equal to or more than 450 mm and less than 550 mm.

There is provided an H-shaped steel product produced by the method for producing H-shaped steel described above. The H-shaped steel product is shaped by using, as a material, a slab with a width of 2050 mm or less and a thickness of equal to or more than 290 mm and equal to or less than 310 mm, and the H-shaped steel product has a web height of equal to or more than 950 mm and less than 1050 mm and a flange width of equal to or more than 550 mm and less than 650 mm.

There is provided an H-shaped steel product produced by the method for producing H-shaped steel described above. The H-shaped steel product is shaped by using, as a material, a slab with a width of 2150 mm or less and a thickness of equal to or more than 290 mm and equal to or less than 310 mm, and the H-shaped steel product has a web height of equal to or more than 1050 mm and less than 1150 mm and a flange width of equal to or more than 550 mm and less than 650 mm.

There is provided an H-shaped steel product produced by the method for producing H-shaped steel described above. The H-shaped steel product is shaped by using, as a material, a slab with a width of 2250 mm or less and a thickness of equal to or more than 290 mm and equal to or less than 310 mm, and the H-shaped steel product has a web height of equal to or more than 1150 mm and less than 1250 mm and a flange width of equal to or more than 550 mm and less than 650 mm.

There is provided an H-shaped steel product produced by the method for producing H-shaped steel described above. The H-shaped steel product is shaped by using, as a material, a slab with a width of 2350 mm or less and a thickness of equal to or more than 290 mm and equal to or less than 310 mm, and the H-shaped steel product has a web height of equal to or more than 1250 mm and less than 1350 mm and a flange width of equal to or more than 550 mm and less than 650 mm.

There is provided an H-shaped steel product produced by the method for producing H-shaped steel described above. The H-shaped steel product is shaped by using, as a material, a slab with a width of 2450 mm or less and a thickness of equal to or more than 290 mm and equal to or less than 310 mm, and the H-shaped steel product has a web height of equal to or more than 1350 mm and less than 1450 mm and a flange width of equal to or more than 550 mm and less than 650 mm.

There is provided an H-shaped steel product produced by the method for producing H-shaped steel described above. The H-shaped steel product is shaped by using, as a material, a slab with a width of 2550 mm or less and a thickness of equal to or more than 290 mm and equal to or less than 310 mm, and the H-shaped steel product has a web height of equal to or more than 1450 mm and less than 1550 mm and a flange width of equal to or more than 550 mm and less than 650 mm.

There is provided an H-shaped steel product produced by the method for producing H-shaped steel described above. The H-shaped steel product is shaped by using, as a material, a slab with a width of 2650 mm or less and a thickness of equal to or more than 290 mm and equal to or less than 310 mm, and the H-shaped steel product has a web height of equal to or more than 1550 mm and less than 1650 mm and a flange width of equal to or more than 550 mm and less than 650 mm.

Advantageous Effects of Invention

According to the present invention, it is possible to produce an H-shaped steel product with a flange width larger than a conventional flange width by, in a rough rolling step using calibers in producing H-shaped steel, creating deep splits on end surfaces of a material (e.g., slab) using projections with acute-angle tip shapes, and sequentially bending flange portions formed by the splits.

REFERENCE SIGNS LIST

Figure 1:
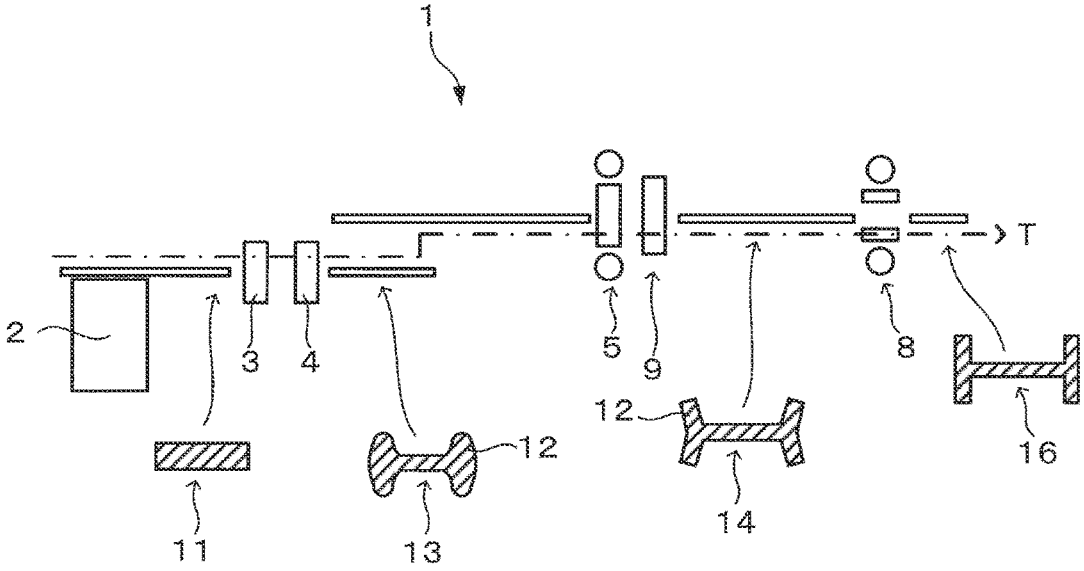
FIG. 1 is a schematic explanatory diagram for a production line of H-shaped steel.

1 rolling equipment
2 heating furnace
3 sizing mill
4 rough rolling mill
5 intermediate universal rolling mill
8 finishing universal rolling mill
9 edger rolling mill
11 slab
12 flange-corresponding portion
13 H-shaped raw blank
14 intermediate material
16 H-shaped steel product
20 upper caliber roll (first caliber)
21 lower caliber roll (first caliber)
25, 26 projection (first caliber)
28, 29 split (first caliber)
30 upper caliber roll (second caliber)
31 lower caliber roll (second caliber)
35, 36 projection (second caliber)
38, 39 split (second caliber)
40 upper caliber roll (third caliber)
41 lower caliber roll (third caliber)
45, 46 projection (third caliber)
48, 49 split (third caliber)
50 upper caliber roll (fourth caliber)
51 lower caliber roll (fourth caliber)
55, 56 projection (fourth caliber)
58, 59 split (fourth caliber)
60 upper caliber roll (fifth caliber)
61 lower caliber roll (fifth caliber)
65, 66 projection (fifth caliber)
68, 69 split (fifth caliber)
70 upper caliber roll (sixth caliber)
71 lower caliber roll (sixth caliber)
80 flange portion
89 web portion
90 upper caliber roll (seventh caliber)
91 lower caliber roll (seventh caliber)
100 upper horizontal roll
100*a*, 100*b* corner portion
101 lower horizontal roll
101*a*, 101*b* corner portion
K1 first caliber
K2 second caliber
K3 third caliber
K4 fourth caliber
K5 fifth caliber
K6 sixth caliber
K7 seventh caliber
T production line
A material to be rolled

DESCRIPTION OF EMBODIMENTS

Hereinafter, (an) embodiment(s) of the present invention will be described with reference to the drawings. In this specification and the appended drawings, structural elements that have substantially the same function and structure are denoted with the same reference numerals, and repeated explanation of these structural elements is omitted.

FIG. 1 is an explanatory diagram for a production line T of H-shaped steel including rolling equipment 1 according to the present embodiment. As illustrated in FIG. 1, a heating furnace 2, a sizing mill 3, a rough rolling mill 4, an intermediate universal rolling mill 5, and a finishing universal rolling mill 8 are arranged in order from the upstream side in the production line T. In addition, an edger rolling mill 9 is provided close to the intermediate universal rolling mill 5. In the description below, steel materials in the production line T are collectively referred to as a "material to be rolled A" for description, and the shape thereof is illustrated with broken lines and oblique lines as appropriate in each drawing in some cases.

As illustrated in FIG. 1, in the production line T, the material to be rolled A, such as a slab 11, extracted from the heating furnace 2 is roughly rolled in the sizing mill 3 and the rough rolling mill 4, and then is subjected to intermediate rolling in the intermediate universal rolling mill 5. In this intermediate rolling, reduction is performed on end portions (flange-corresponding portions 12) of the material to be rolled, for example, by the edger rolling mill 9 as necessary. In a normal case, approximately four to six calibers in total are engraved on rolls of the sizing mill 3 and the rough rolling mill 4, and an H-shaped raw blank 13 is shaped through reverse rolling of approximately a little over ten passes by way of these calibers. Reduction of a plurality of passes is applied to the H-shaped raw blank 13 using a rolling mill train composed of two rolling mills of the intermediate universal rolling mill 5 and the edger rolling mill 9; thus, an intermediate material 14 is shaped. The intermediate material 14 is finish-rolled into a product shape in the finishing universal rolling mill 8, so that an H-shaped steel product 16 is produced.

Next, description will be given on configurations and shapes of calibers that are engraved in the sizing mill 3 and the rough rolling mill 4 illustrated in FIG. 1, with reference to drawings. Note that the heating furnace 2, the intermediate universal rolling mill 5, the finishing universal rolling mill 8, the edger rolling mill 9, and the like in the production line T are general devices conventionally used in production of H-shaped steel, and their device configurations and the like are known; thus, description of these devices is omitted in this specification.

FIGS. 2 to 8 are schematic explanatory diagrams for calibers that are engraved in the sizing mill 3 and the rough rolling mill 4, which perform a rough rolling step. Here, first to seventh calibers to be described may all be engraved in the sizing mill 3, for example, or seven calibers of the first to seventh calibers may be engraved separately in the sizing mill 3 and the rough rolling mill 4. In a rough rolling step in normal production of H-shaped steel, multi-pass rolling is performed in each caliber. Note that the number of calibers for performing a rolling step is not limited to this. That is, the first to seventh calibers may be engraved across both the sizing mill 3 and the rough rolling mill 4, or may be engraved in either one of the rolling mills.

In the present embodiment, a case where seven calibers are engraved is described as an example, but the number of calibers is not necessarily seven, and any caliber configuration suitable for shaping the H-shaped raw blank 13 may be employed. Note that FIGS. 2 to 8 illustrate, with broken lines, the schematic shape of the material to be rolled A in shaping in each caliber.

Figure 2:
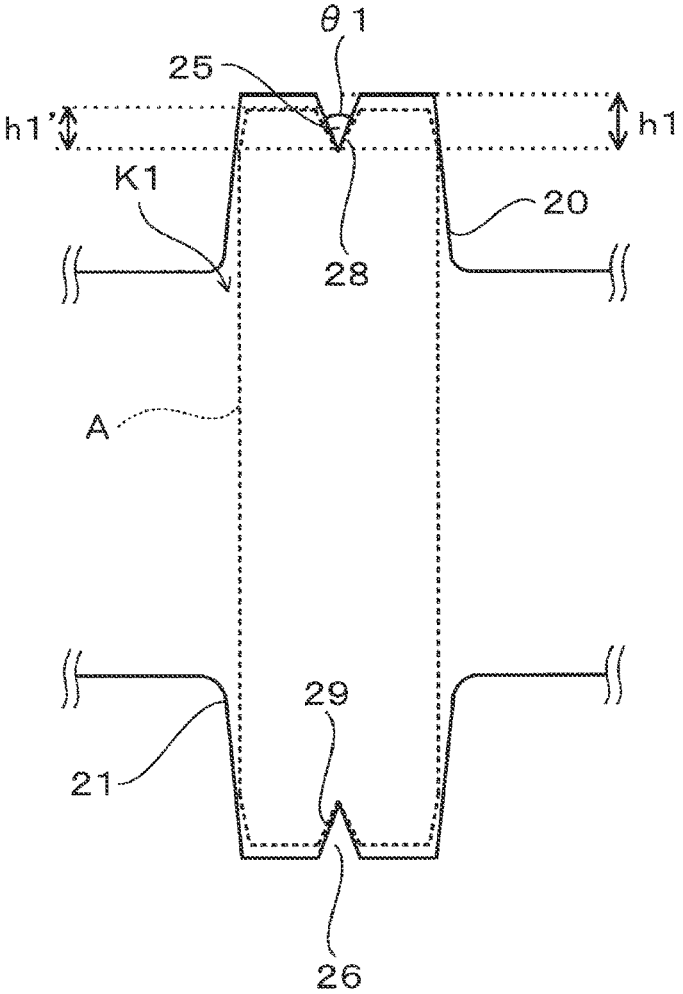
FIG. 2 is a schematic explanatory diagram of a first caliber.

FIG. 2 is a schematic explanatory diagram of a first caliber K1. The first caliber K1 is engraved on a pair of horizontal rolls, an upper caliber roll 20 and a lower caliber roll 21, and the material to be rolled A is subjected to reduction and shaping in a roll gap between the upper caliber roll 20 and the lower caliber roll 21. On a peripheral surface of the upper caliber roll 20 (i.e., a top surface of the first caliber K1), a projection 25 protruding toward the inside of the caliber is formed. Furthermore, on a peripheral surface of the lower caliber roll 21 (i.e., a bottom surface of the first caliber K1), a projection 26 protruding toward the inside of the caliber is formed. These projections 25 and 26 have tapered shapes, and dimensions, such as protrusion length, are configured to be equal between the projections 25 and 26. The height (protrusion length) of the projections 25 and 26 is denoted by h1, and a tip-portion angle thereof is denoted by θ1.

In this first caliber K1, the projections 25 and 26 are pressed against upper and lower end portions of the material to be rolled A (slab end surfaces) to form splits 28 and 29. Here, the tip-portion angle of the projections 25 and 26 (also called a wedge angle) 01 is preferably equal to or more than 25° and equal to or less than 40°, for example, further preferably in a range of equal to or more than 25° and equal to or less than 35°.

Here, a caliber width of the first caliber K1 is preferably substantially equal to a thickness of the material to be rolled A (i.e., a slab thickness). Specifically, when the width of the caliber at the tip portions of the projections 25 and 26 formed in the first caliber K1 is set to be the same as the slab thickness, the property of left-right centering of the material to be rolled A is ensured suitably. Moreover, it is preferable to employ this configuration of caliber dimensions so that, in shaping using the first caliber K1, the projections 25 and 26 and part of side surfaces (side walls) of the caliber be in contact with the material to be rolled A at the upper and lower end portions of the material to be rolled A (the slab end surfaces), and active reduction not be performed by the top surface and the bottom surface of the first caliber K1 on slab upper and lower end portions, which are divided into four elements (parts) by the splits 28 and 29, as illustrated in FIG. 2. This is because reduction by the top surface and the bottom surface of the caliber causes stretch of the material to be rolled A in the longitudinal direction, which decreases efficiency in generating flanges (flange portions 80 described later).

Figure 3:
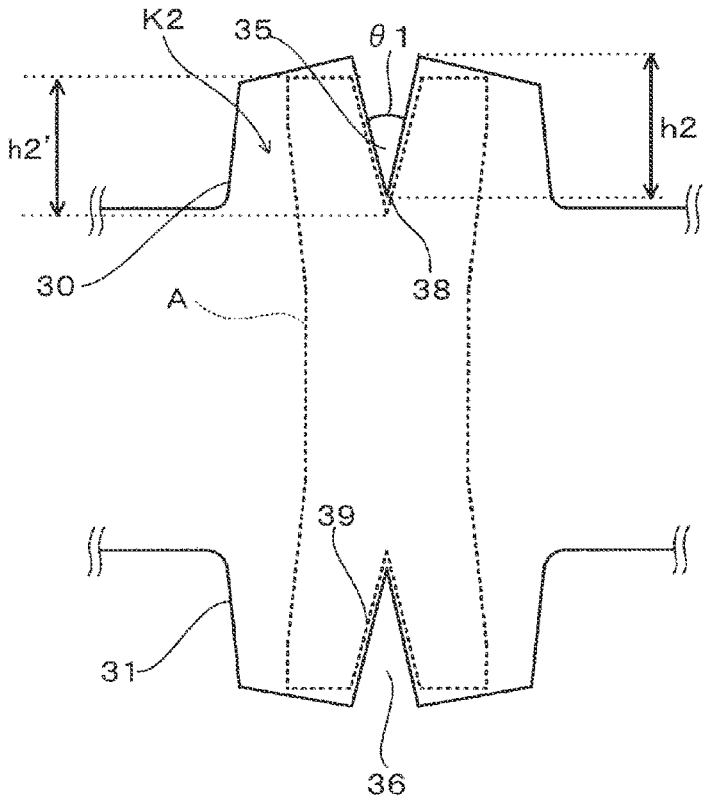
FIG. 3 is a schematic explanatory diagram of a second caliber.

FIG. 3 is a schematic explanatory diagram of a second caliber K2. The second caliber K2 is engraved on a pair of horizontal rolls, an upper caliber roll 30 and a lower caliber roll 31. On a peripheral surface of the upper caliber roll 30 (i.e., a top surface of the second caliber K2), a projection 35 protruding toward the inside of the caliber is formed. Furthermore, on a peripheral surface of the lower caliber roll 31 (i.e., a bottom surface of the second caliber K2), a projection 36 protruding toward the inside of the caliber is formed. These projections 35 and 36 have tapered shapes, and dimensions, such as protrusion length, are configured to be equal between the projections 35 and 36. The tip-portion angle θ1 of the projections 35 and 36 (wedge angle θ1) is preferably equal to or more than 25° and equal to or less than 40°, further preferably equal to or more than 25° and equal to or less than 35°.

Here, description is given on reasons for setting the suitable numerical range of the wedge angle θ1 of the projections 35 and 36 to equal to or more than 25° and equal to or less than 40° (further preferably equal to or more than 25° and equal to or less than 35°) and a reason for accordingly setting the wedge angle θ1 of the first caliber K1 to the suitable numerical range, with reference to drawings (graphs).

A lower limit value of a wedge angle is normally decided by the strength of a roll. The material to be rolled A comes into contact with the rolls (the upper caliber roll 30 and the lower caliber roll 31 in the second caliber K2, and the upper caliber roll 20 and the lower caliber roll 21 in the first caliber K1), and the rolls are subjected to heat during the contact to swell, and when the material to be rolled A goes out of contact with the rolls, the rolls are cooled to shrink. This cycle is repeated during shaping; when the wedge angle is too small, the projections (the projections 35 and 36 in the second caliber K2, and the projections 25 and 26 in the first caliber K1) have small thicknesses, and this makes heat input from the material to be rolled A easily enter from the left and right of the projections, making the rolls have higher temperatures. When the rolls have high temperatures, thermal amplitude increases to cause a heat crack, which may break the rolls. For this reason, the wedge angle θ1 is preferably 25° or more.

On the other hand, when the wedge angle θ1 is large, a wedge inclination angle is enlarged, which makes pressing force in the up-and-down direction due to friction force easily act on the material to be rolled A; thus, a reduction in cross-sectional area occurs at inner surface portions of flange-corresponding portions in split formation, causing a decrease in efficiency in generating flanges particularly in shaping using the second caliber K2 and subsequent calibers. Here, the relation between the wedge angle θ1 of the second caliber K2 and a flange width of the material to be rolled A that is finally shaped is described, and a suitable upper limit value of the wedge angle θ1 is described, with reference to FIG. 18.

Figure 18:
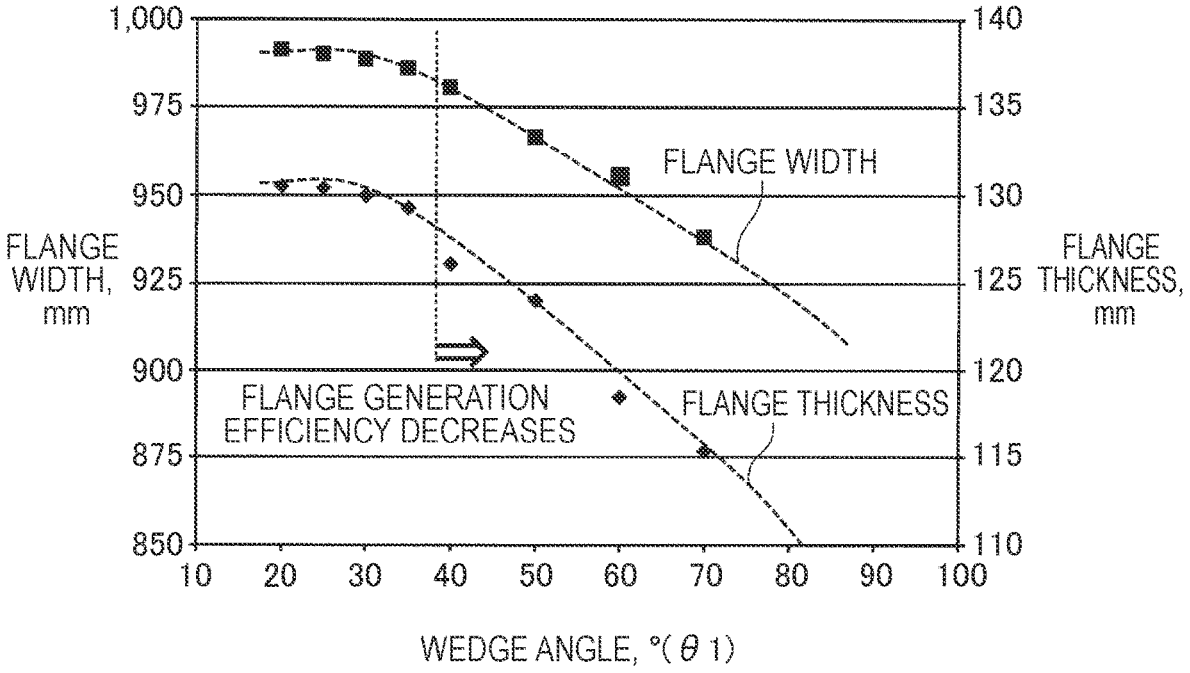
FIG. 18 is a graph showing the relation with numerical values of flange width and flange thickness when a wedge angle θ1 is changed.

FIG. 18 shows analysis results by a FEM, and is a graph showing the relation with numerical values of flange thickness and flange width in a subsequent step (a step using a third caliber K3 described later) when the wedge angle θ1 of the second caliber K2 is changed. As calculation conditions, a slab width and a slab thickness of a material are set to 2300 mm and 300 mm, respectively, and a method described in the present embodiment is used, assuming that the material to be rolled A is shaped with the wedge angle θ1 changed among predetermined angles, about 20° to about 70°.

As shown in FIG. 18, the graph shows that in the case where the rough rolling step is performed with the wedge angle θ1 set to more than 40° and an H-shaped steel product is shaped, flange width and flange thickness both decrease significantly, which indicates a decrease in efficiency in generating flanges. That is, in the case where the wedge angle θ1 is set to more than 40°, the graph is significantly steep, and flange width and flange thickness decrease greatly, as compared with the case where the wedge angle θ1 is 40° or less. As the wedge angle θ1 becomes more obtuse, a reduction in cross-sectional area at the flange-corresponding portions (induction of metal flow in the longitudinal direction of the material to be rolled A) increases. From this viewpoint, setting the wedge angle θ1 to 40° or less enables high efficiency in generating flanges to be achieved. In addition, FIG. 18 shows that it is preferable to set the wedge angle θ1 to 35° or less to achieve higher efficiency in generating flanges.

Moreover, for high inductivity and secured rolling stability, the wedge angle θ1 of the first caliber K1 is preferably the same angle as the wedge angle θ1 of the second caliber K2 subsequent to the first caliber K1.

Figure 19:
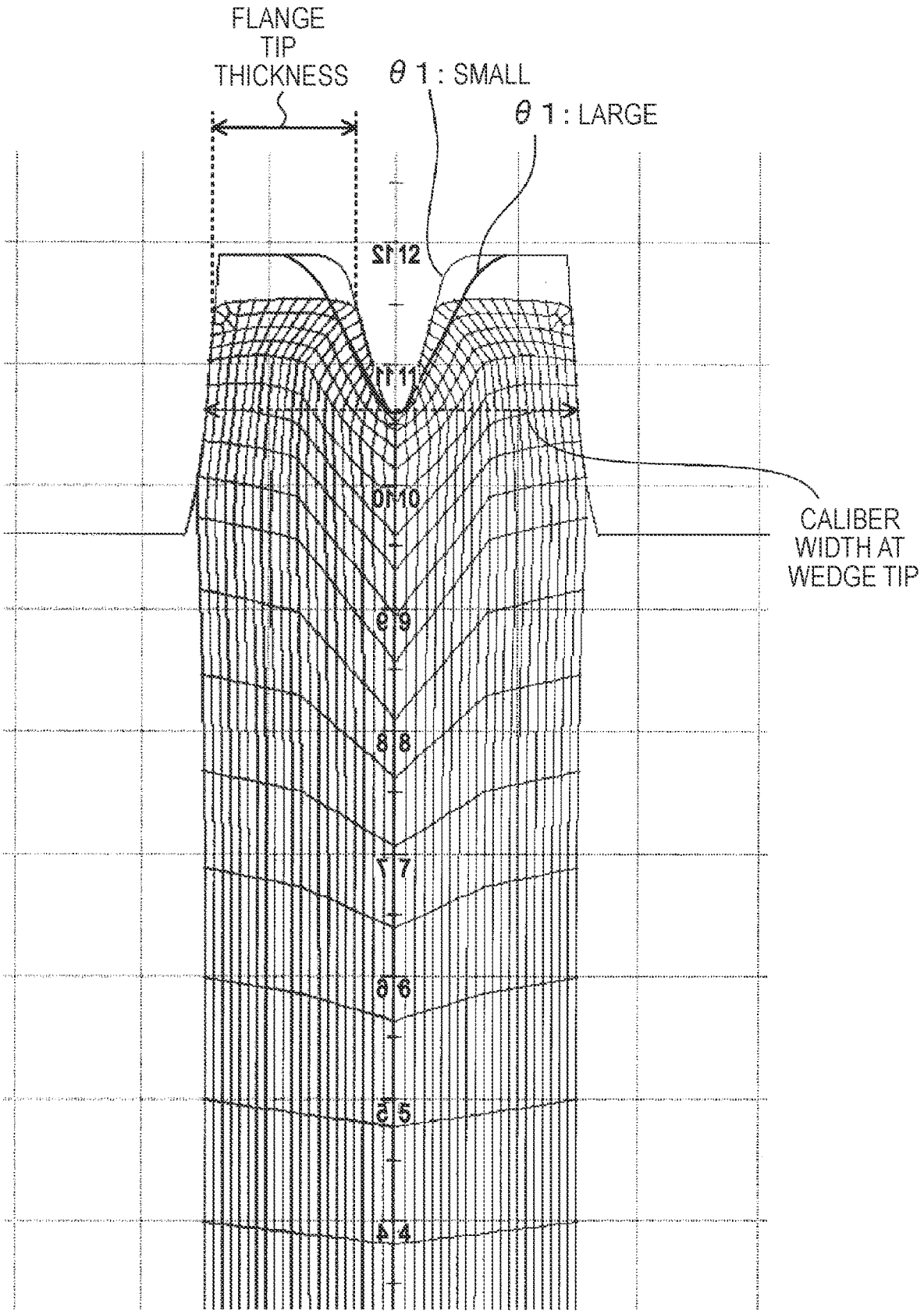
FIG. 19 is a schematic cross-sectional view of an intermediate pass of the first caliber.
Figure 20:
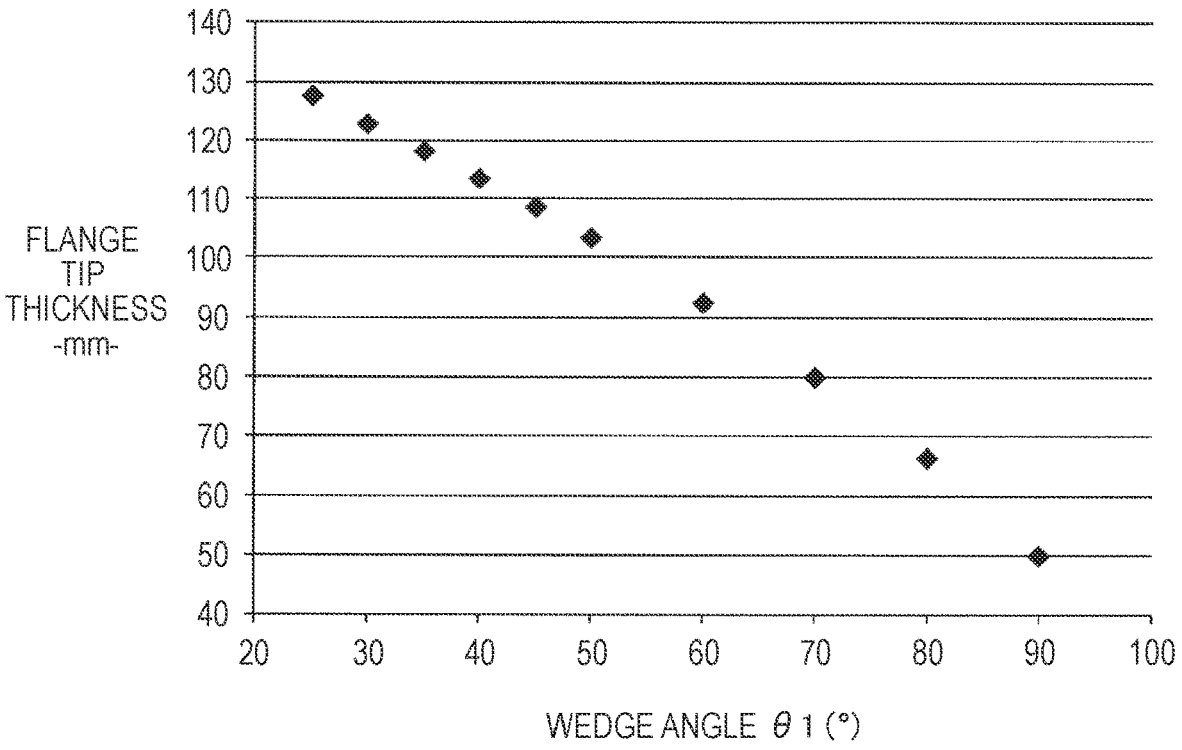
FIG. 20 is a graph showing the relation with numerical values of flange tip thickness when a wedge angle θ1 is changed.

The wedge angle θ1 of the first caliber K1 is known to greatly contribute to tip-portion thicknesses of the flange-corresponding portions (later flange portions 80); in this respect, the wedge angle θ1 is preferably as small as possible. FIG. 19 is a schematic cross-sectional view of an intermediate pass of the first caliber K1, and illustrates a state where the split 28 is provided on one slab end surface (the upper end portion in FIG. 2). FIG. 19 shows a difference due to the magnitude of the wedge angle θ1 in providing the split 28, illustrating the split shape in each case. FIG. 20 is a graph showing the relation between the wedge angle θ1 of the first caliber K1 and a tip thickness of a flange-corresponding portion (flange tip thickness), and shows a case where a wedge height is 100 mm and a slab thickness is 300 mm, as an example.

As shown in FIGS. 19 and 20, in a cross-section when the wedge angle θ1 is large, metal at slab end surfaces is lessened, which leads to a decrease in tip-portion thicknesses of the flange-corresponding portions (later flange portions 80) of the slab end surfaces, as compared with a cross-section when the wedge angle θ1 is small. The decrease in tip-portion thicknesses of the flange-corresponding portions (later flange portions 80) is not preferable in view of the shape of a later H-shaped steel product; hence, to ensure the tip-portion thicknesses of the flange-corresponding portions, it is necessary to determine a suitable upper limit value of the wedge angle θ1.

As described above, in addition to setting the wedge angle θ1 of the second caliber K2 to equal to or more than 25° and equal to or less than 40°, it is preferable to set the wedge angle θ1 of the first caliber K1 to the same angle, i.e., equal to or more than 25° and equal to or less than 40°, from the viewpoints of ensuring the tip-portion thicknesses of the flange-corresponding portions and securing inductivity and rolling stability.

A height (protrusion length) h2 of the projections 35 and 36 is configured to be larger than the height h1 of the projections 25 and 26 of the first caliber K1; h2>h1 is satisfied. Moreover, in terms of dimensional accuracy of rolling, the tip-portion angle of the projections 35 and 36 is preferably the same (i.e., θ1) as the tip-portion angle of the projections 25 and 26 of the first caliber K1. The material to be rolled A that has passed through the first caliber K1 is further shaped in a roll gap between the upper caliber roll 30 and the lower caliber roll 31.

Here, the height h2 of the projections 35 and 36 formed in the second caliber K2 is larger than the height h1 of the projections 25 and 26 formed in the first caliber K1, and similarly, an intrusion length into the upper and lower end portions of the material to be rolled A (the slab end surfaces) is larger for the second caliber K2. That is, an intrusion depth h1' of the projections 25 and 26 into the material to be rolled A in the first caliber K1 and an intrusion depth h2' of the projections 35 and 36 into the material to be rolled A in the second caliber K2 satisfy a relation of h1'<h2'.

As illustrated in FIG. 3, in the second caliber K2, since the intrusion length of the projections is large when the projections are pressed against the upper and lower end portions of the material to be rolled A (the slab end surfaces), shaping is performed to make the splits 28 and 29 formed in the first caliber K1 further deeper, forming splits 38 and 39. Note that a flange half-width at the end of a flange shaping step in the rough rolling step is decided on the basis of dimensions of the splits 38 and 39 formed here. More detailed description on the dimensions of the splits 38 and 39 will be given later with reference to drawings.

As illustrated in FIG. 3, in shaping using the second caliber K2, the caliber is not in contact with the material to be rolled A, besides the projections 35 and 36, at the upper and lower end portions of the material to be rolled A (the slab end surfaces), and active reduction is not performed on the material to be rolled A in the second caliber K2. This is because, as with the first caliber K1, reduction causes stretch of the material to be rolled A in the longitudinal direction, which decreases efficiency in generating the flanges (the flange portions 80 described later).

Figure 4:
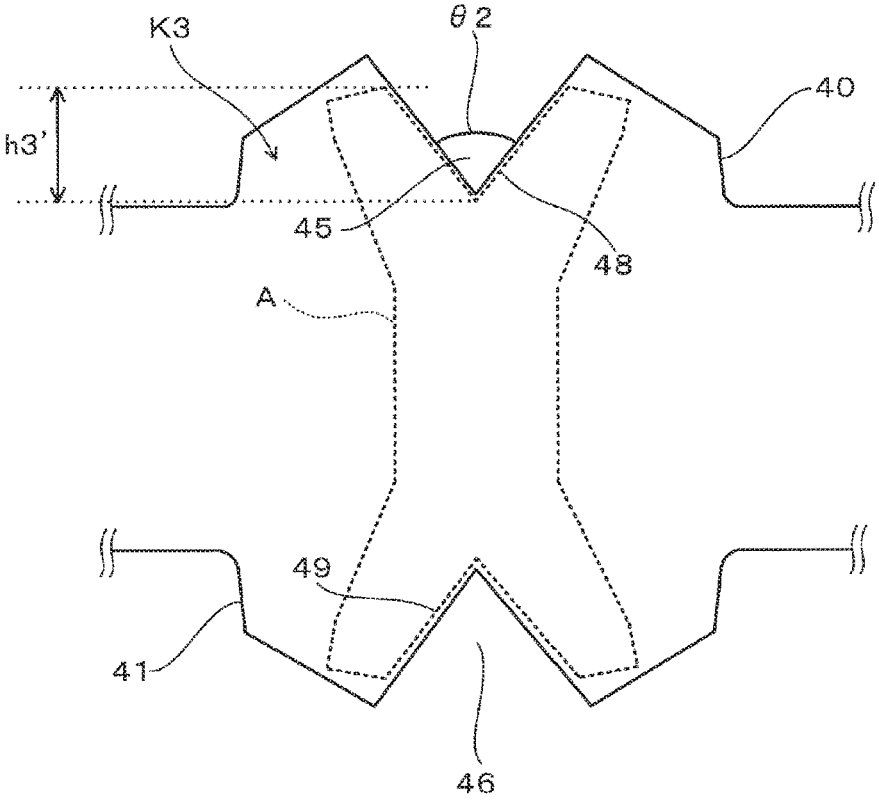
FIG. 4 is a schematic explanatory diagram of a third caliber.

FIG. 4 is a schematic explanatory diagram of a third caliber K3. The third caliber K3 is engraved on a pair of horizontal rolls, an upper caliber roll 40 and a lower caliber roll 41. On a peripheral surface of the upper caliber roll 40 (i.e., a top surface of the third caliber K3), a projection 45 protruding toward the inside of the caliber is formed. Furthermore, on a peripheral surface of the lower caliber roll 41 (i.e., a bottom surface of the third caliber K3), a projection 46 protruding toward the inside of the caliber is formed. These projections 45 and 46 have tapered shapes, and dimensions, such as protrusion length, are configured to be equal between the projections 45 and 46.

A tip-portion angle θ2 of the projections 45 and 46 is configured to be wider than the angle θ1, and an intrusion depth h3' of the projections 45 and 46 into the material to be rolled A is shorter than the intrusion depth h2' of the projections 35 and 36 (i.e. h3'<h2').

As illustrated in FIG. 4, in the third caliber K3, the material to be rolled A that has passed through the second caliber K2 is shaped in the following manner: the projections 45 and 46 are pressed against the splits 38 and 39 formed in the second caliber K2, at the upper and lower end portions of the material to be rolled A (the slab end surfaces); thus, the splits 38 and 39 become splits 48 and 49. That is, in a final pass in shaping using the third caliber K3, a deepest-portion angle of the splits 48 and 49 (hereinafter also called a split angle) becomes θ2. In other words, shaping is performed in a manner that the divided parts (parts corresponding to the flange portions 80 described later) shaped together with the formation of the splits 38 and 39 in the second caliber K2 are bent outwardly.

As illustrated in FIG. 4, in shaping using the third caliber K3, the caliber is not in contact with the material to be rolled A, besides the projections 45 and 46, at the upper and lower end portions of the material to be rolled A (the slab end surfaces), and active reduction is not performed on the material to be rolled A in the third caliber K3. This is because, as with the first caliber K1 and the like, reduction causes stretch of the material to be rolled A in the longitudinal direction, which decreases efficiency in generating the flanges (the flange portions 80 described later).

Figure 5:
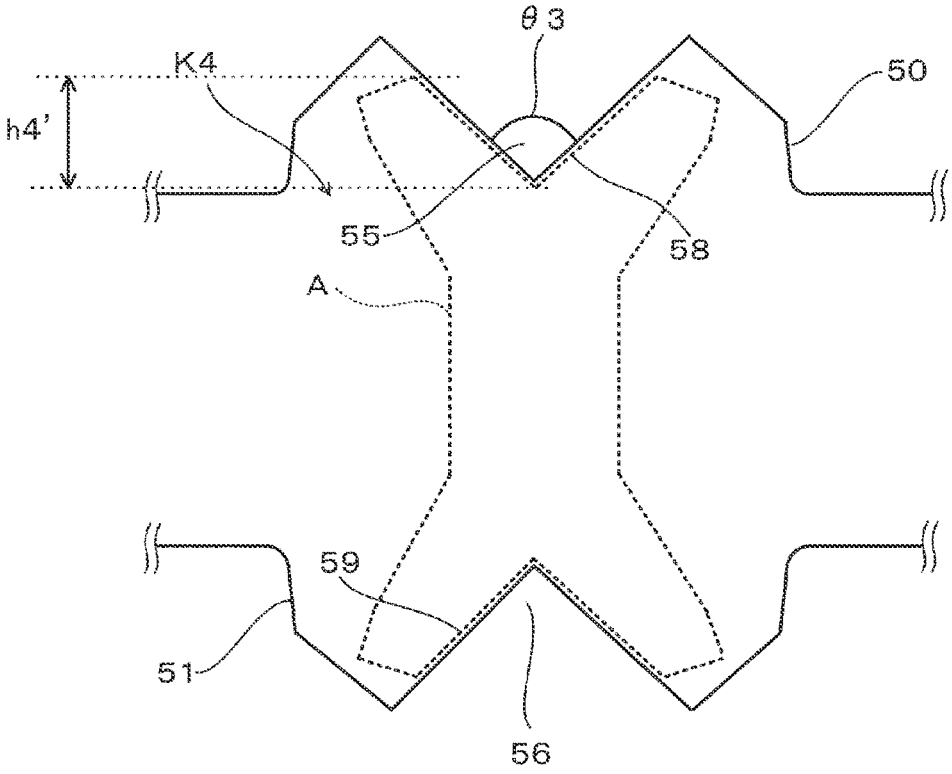
FIG. 5 is a schematic explanatory diagram of a fourth caliber.

FIG. 5 is a schematic explanatory diagram of a fourth caliber K4. The fourth caliber K4 is engraved on a pair of horizontal rolls, an upper caliber roll 50 and a lower caliber roll 51. On a peripheral surface of the upper caliber roll 50 (i.e., a top surface of the fourth caliber K4), a projection 55 protruding toward the inside of the caliber is formed. Furthermore, on a peripheral surface of the lower caliber roll 51 (i.e., a bottom surface of the fourth caliber K4), a projection 56 protruding toward the inside of the caliber is formed. These projections 55 and 56 have tapered shapes, and dimensions, such as protrusion length, are configured to be equal between the projections 55 and 56.

A tip-portion angle θ3 of the projections 55 and 56 is configured to be wider than the angle θ2, and an intrusion depth h4' of the projections 55 and 56 into the material to be rolled A is shorter than the intrusion depth h3' of the projections 45 and 46 (i.e. h4'<h3').

In the fourth caliber K4, the material to be rolled A that has passed through the third caliber K3 is shaped in the following manner: the projections 55 and 56 are pressed against the splits 48 and 49 formed in the third caliber K3, at the upper and lower end portions of the material to be rolled A (the slab end surfaces); thus, the splits 48 and 49 are expanded to become splits 58 and 59. That is, in a final pass in shaping using the fourth caliber K4, a deepest-portion angle of the splits 58 and 59 (hereinafter also called a split angle) becomes θ3. In other words, shaping is performed in a manner that the divided parts (parts corresponding to the flange portions 80 described later) shaped together with the formation of the splits 48 and 49 in the third caliber K3 are further bent outwardly.

As illustrated in FIG. 5, in shaping using the fourth caliber K4, the caliber is not in contact with the material to be rolled A, besides the projections 55 and 56, at the upper and lower end portions of the material to be rolled A (the slab end surfaces), and active reduction is not performed on the material to be rolled A in the fourth caliber K4. This is because, as with the first caliber K1 and the like, reduction causes stretch of the material to be rolled A in the longitudinal direction, which decreases efficiency in generating the flanges (the flange portions 80 described later).

Figure 6:
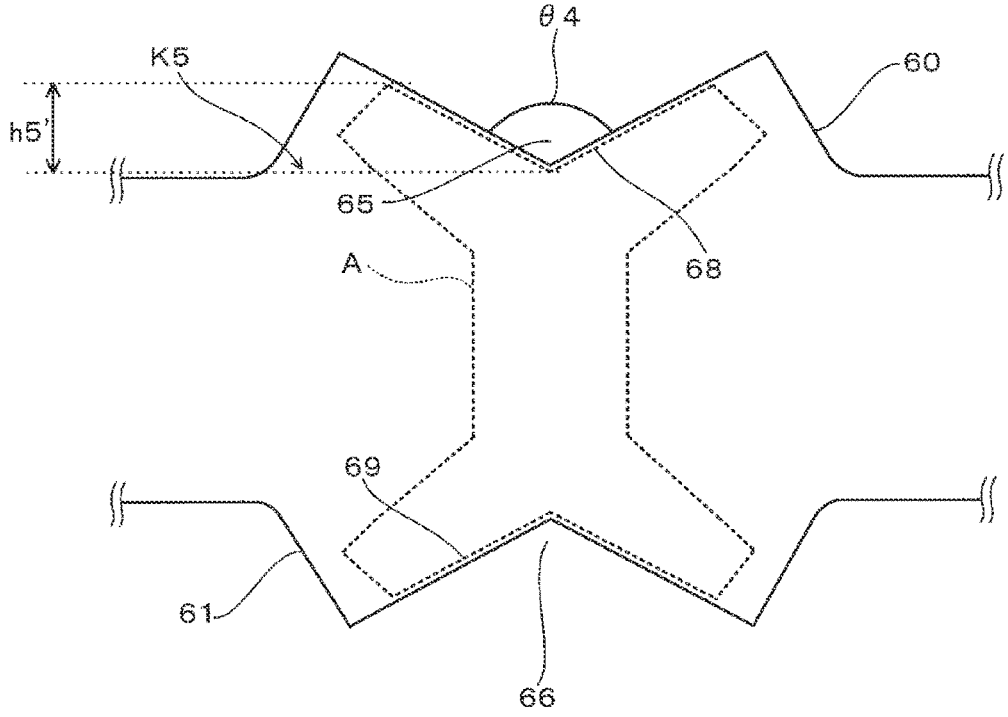
FIG. 6 is a schematic explanatory diagram of a fifth caliber.

FIG. 6 is a schematic explanatory diagram of a fifth caliber K5. The fifth caliber K5 is engraved on a pair of horizontal rolls, an upper caliber roll 60 and a lower caliber roll 61. On a peripheral surface of the upper caliber roll 60 (i.e., a top surface of the fifth caliber K5), a projection 65 protruding toward the inside of the caliber is formed. Furthermore, on a peripheral surface of the lower caliber roll 61 (i.e., a bottom surface of the fifth caliber K5), a projection 66 protruding toward the inside of the caliber is formed. These projections 65 and 66 have tapered shapes, and dimensions, such as protrusion length, are configured to be equal between the projections 65 and 66.

A tip-portion angle θ4 of the projections 65 and 66 is configured to be wider than the angle θ3, and an intrusion depth h5' of the projections 65 and 66 into the material to be rolled A is shorter than the intrusion depth h4' of the projections 55 and 56 (i.e. h5'<h4').

In the fifth caliber K5, the material to be rolled A that has passed through the fourth caliber K4 is shaped in the following manner: the projections 65 and 66 are pressed against the splits 58 and 59 formed in the fourth caliber K4, at the upper and lower end portions of the material to be rolled A (the slab end surfaces); thus, the splits 58 and 59 are expanded to become splits 68 and 69. That is, in a final pass in shaping using the fifth caliber K5, a deepest-portion angle of the splits 68 and 69 (hereinafter also called a split angle) becomes θ4. In other words, shaping is performed in a manner that the divided parts (parts corresponding to the flange portions 80 described later) shaped together with the formation of the splits 58 and 59 in the fourth caliber K4 are further bent outwardly.

As illustrated in FIG. 6, in shaping using the fifth caliber K5, the caliber is not in contact with the material to be rolled A, besides the projections 65 and 66, at the upper and lower end portions of the material to be rolled A (the slab end surfaces), and active reduction is not performed on the material to be rolled A in the fifth caliber K5. This is because, as with the first caliber K1 and the like, reduction causes stretch of the material to be rolled A in the longitudinal direction, which decreases efficiency in generating the flanges (the flange portions 80 described later).

Figure 7:
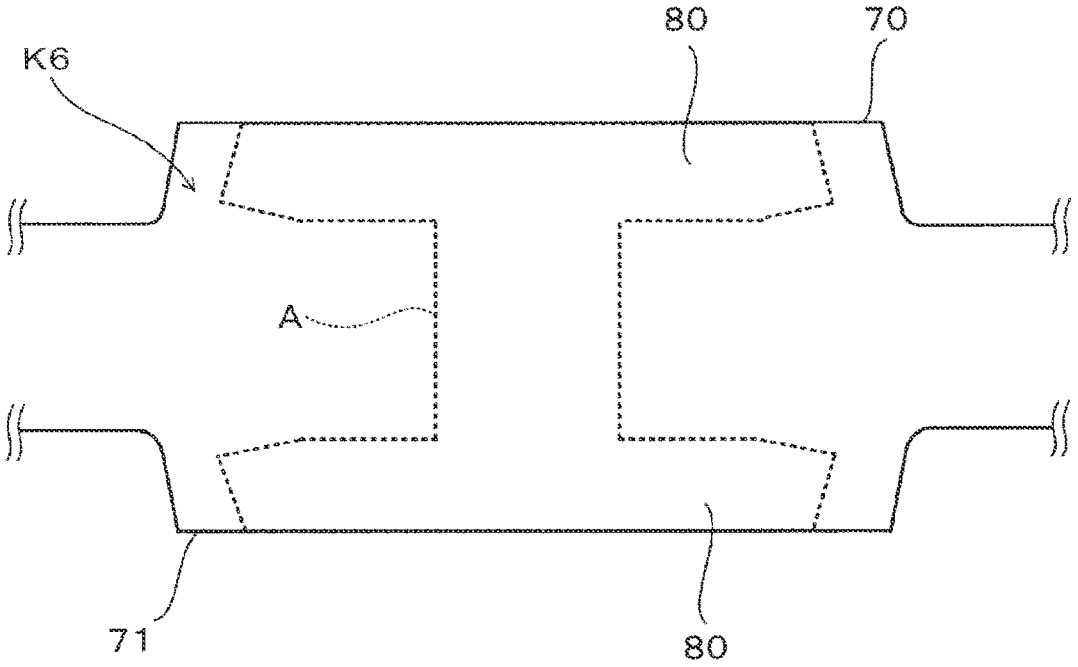
FIG. 7 is a schematic explanatory diagram of a sixth caliber.

FIG. 7 is a schematic explanatory diagram of a sixth caliber K6. The sixth caliber K6 is composed of a pair of horizontal rolls, an upper caliber roll 70 and a lower caliber roll 71. The upper caliber roll 70 and the lower caliber roll 71 have roll peripheral surfaces that are horizontal with respect to the material to be rolled A. In this sixth caliber K6, reduction is performed to a degree that the splits 68 and 69 formed in the fifth caliber K5 can be erased. Specifically, reduction is preferably applied in an amount of approximately 50 mm to 60 mm per pass more than the depth of the splits 68 and 69 formed in the fifth caliber K5 (i.e., the intrusion depth h5' of the projections 65 and 66 into the material to be rolled A).

In the sixth caliber K6 illustrated in FIG. 7, the material to be rolled A that has passed through the fifth caliber K5 is shaped in a manner that the formed splits 68 and 69 are expanded, and the divided parts (later flange portions 80) are further bent outwardly to become substantially flat surfaces in a final pass. That is, shaping is performed in a manner that the deepest-portion angle θ4 of the splits 68 and 69 formed in the fifth caliber K5 becomes substantially 180° through shaping using the sixth caliber K6. In the description below, upper and lower end portions of the material to be rolled A that have been shaped in this manner to be substantially flat are called the flange portions 80.

Figure 8:
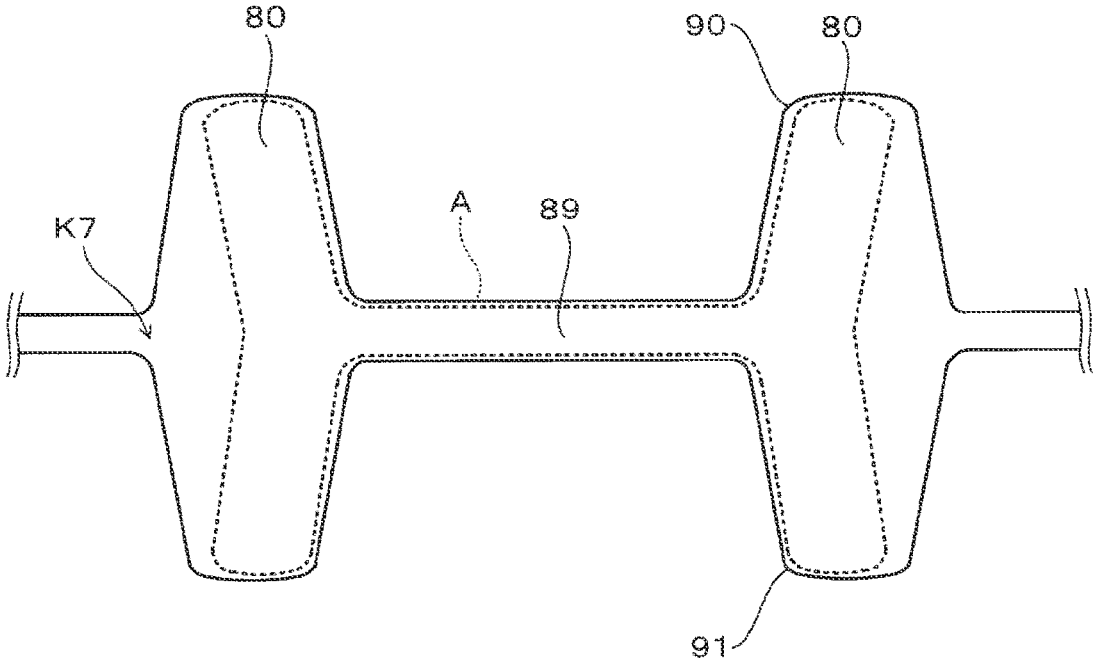
FIG. 8 is a schematic explanatory diagram of a seventh caliber.

FIG. 8 is a schematic explanatory diagram of a seventh caliber K7. The seventh caliber K7 is composed of a pair of horizontal rolls, an upper caliber roll 90 and a lower caliber roll 91. As illustrated in FIG. 8, in the seventh caliber K7, the material to be rolled A shaped in the calibers up to the sixth caliber K6 is rotated by 90° or 270°, so that the flange portions 80 that have been positioned at upper and lower ends of the material to be rolled A in the calibers up to the sixth caliber K6 are brought on a rolling pitch line. In the seventh caliber K7, a web portion 89, which is a connection portion between the two flange portions 80, is subjected to reduction and widening rolling. In this manner, an H-shaped raw blank with a so-called dog-bone shape (the H-shaped raw blank 13 illustrated in FIG. 1) is shaped. Note that this seventh caliber K7 is also called a web thinning caliber because it performs reduction on the web portion 89 for thinning.

To the H-shaped raw blank 13 shaped in this manner, reduction of a plurality of passes is applied using a rolling mill train composed of two rolling mills of the intermediate universal rolling mill 5 and the edger rolling mill 9, which is illustrated in FIG. 1; thus, the intermediate material 14 is shaped. The intermediate material 14 is finish-rolled into a product shape in the finishing universal rolling mill 8, so that the H-shaped steel product 16 is produced.

As described above, shaping is performed in a manner that splits are created on the upper and lower end portions of the material to be rolled A (the slab end surfaces) by using the first to sixth calibers K1 to K6 according to the present embodiment, and portions divided to left and right by those splits are bent to left and right, so that the flange portions 80 are formed; thus, the H-shaped raw blank 13 can be shaped without the upper and lower end surfaces of the material to be rolled A (slab) being subjected to reduction in the up-and-down direction. That is, as compared with a conventionally performed method in which slab end surfaces are subjected to edging for rough rolling, the H-shaped raw blank 13 can be shaped with a flange width widened, and consequently a final product (H-shaped steel) with a large flange width can be produced. In addition, the H-shaped raw blank 13 can be shaped without being influenced by device limits in an amount of reduction and equipment scale in the sizing mill 3 or the rough rolling mill 4; thus, a slab size of a material can be made smaller than a conventional slab size (a decrease in slab width), which enables efficient production of a final product with a large flange width.

Here, in regard to shaping of the material to be rolled A using the first to sixth calibers K1 to K6, the present inventors carried out extensive studies on conditions for stably shaping flange portions. As a result of the studies, it was found that, to produce an H-shaped steel product having predetermined dimensions (target dimensions) with a large flange width by a method according to the present embodiment, it is suitable to perform shaping of places corresponding to flanges in the second caliber K2 under predetermined conditions. Hence, description on this finding is given below with reference to drawings.

Figure 9:
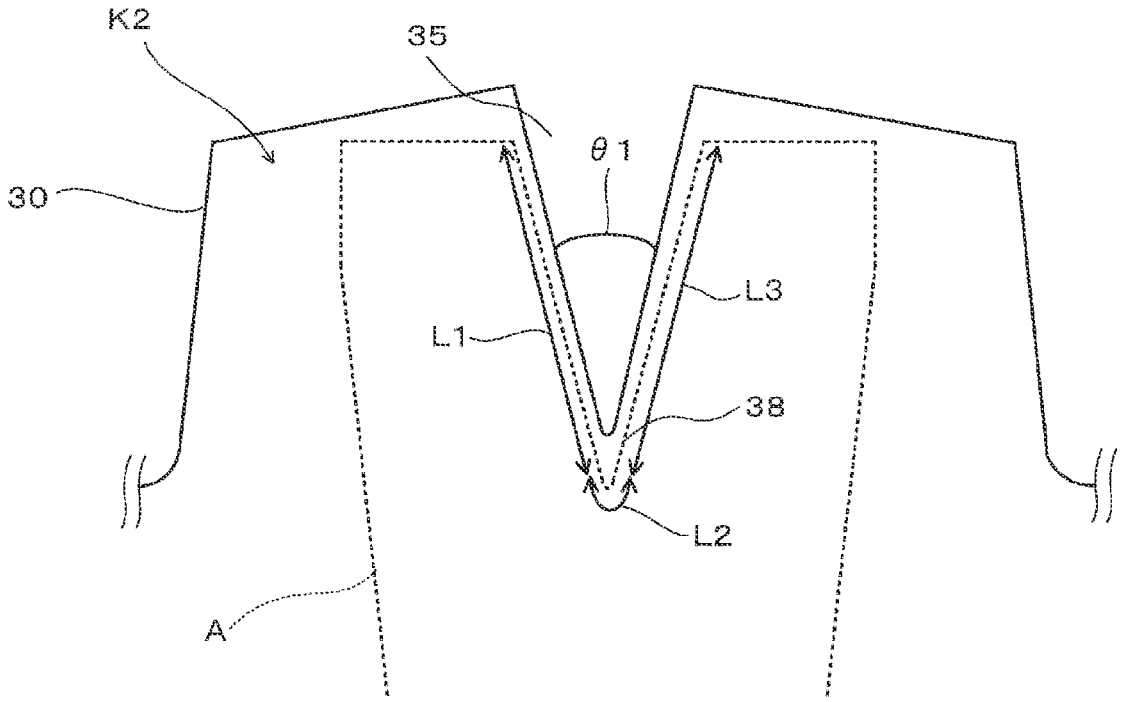
FIG. 9 is a schematic explanatory diagram explaining the manner of shaping in the second caliber, in which part of FIG. 3 is enlarged.
Figure 10:
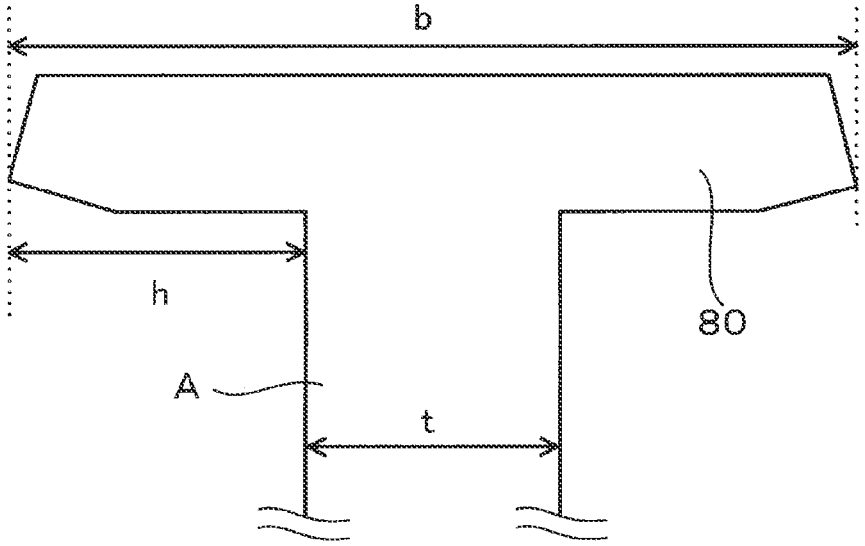
FIG. 10 is an enlarged view of a flange portion of a material to be rolled that has been shaped in the sixth caliber.
Figure 11:
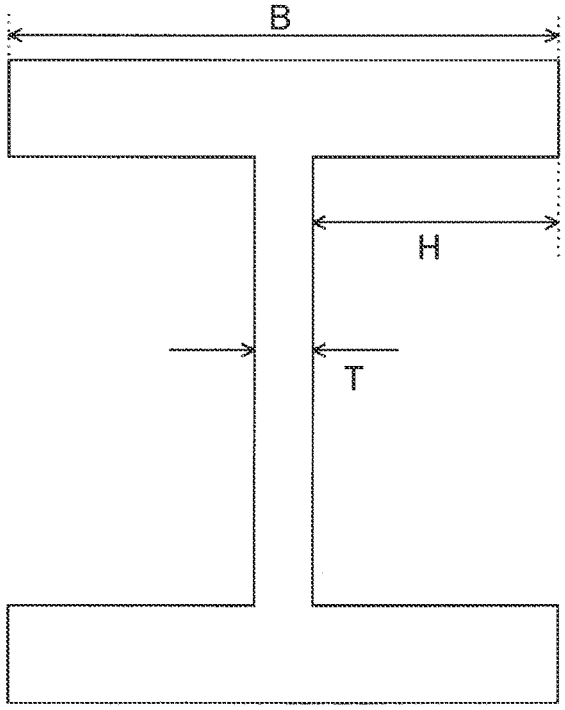
FIG. 11 is an explanatory diagram related to dimensions of H-shaped steel, which is a final product.

FIG. 9 is a schematic explanatory diagram explaining the manner of shaping in the second caliber K2, in which part (the upper half) of FIG. 3 is enlarged. Specifically, the upper half of the second caliber K2 illustrated in FIG. 3 is illustrated enlarged. FIG. 10 is an enlarged view of the flange portion 80 of the material to be rolled A that has been shaped in the sixth caliber K6. FIG. 11 is an explanatory diagram related to dimensions of H-shaped steel, which is a final product. Note that structural elements illustrated in FIGS. 9 and 10 are denoted with the same reference numerals as in FIGS. 3 to 7 in some cases.

The split 38 formed in shaping using the second caliber K2, as illustrated in FIG. 9, is expanded by shaping using the third to sixth calibers K3 to K6, as described with reference to FIGS. 4 to 7, and finally the flange portion 80 illustrated in FIG. 10 is formed. Here, a flange width b of the flange portion 80 is determined on the basis of the length of a split line length L of the split 38, and similarly, a flange half-width h at the end of shaping using the first to sixth calibers (i.e., a flange shaping step in a state where the slab is made vertical, which step is also referred to simply as a flange shaping step in the description below), which is illustrated in FIG. 10, is determined on the basis of the value of this split line length L.

The split line length L is the sum of lengths L1 and L3 of straight-line portions at side walls on both sides of the split 38 and a curved-line length L2 of a part with curvature at a depth end portion of the split 38. That is, L=L1+L2+L3. On the other hand, the flange half-width h at the end of the flange shaping step is determined as h=(b−t)/2 by using the flange width b and a slab thickness t at the end of the flange shaping step.

In addition, as illustrated in FIG. 11, target dimensions of an H-shaped steel product serving as a final product, are prescribed as a product flange width B, a product web thickness T, and a product flange half-width H. Suitable shaping conditions in calibers in this case will be described.

First, as a premise, the product flange half-width H is calculated from the product flange width B and the product web thickness T of the H-shaped steel product serving as a final product with a desired size (desired dimensions), on the basis of an expression (1) below.

$$H=(B-T)/2 \tag{1}$$

Next, the flange half-width h at the end of the flange shaping step is determined so as to be equal to or more than the length of the product flange half-width H determined in the expression (1). That is, the flange half-width h at the end of the flange shaping step that satisfies an expression (2) below is determined.

$$h \geq H \tag{2}$$

This is because it has been found that flange portions of an H-shaped steel product can be stably shaped in the case where the flange half-width h formed through caliber shaping using the first to sixth calibers K1 to K6 has a length of the product flange half-width H or more. Examples of rolling steps after the end of the flange shaping step include a step of decreasing web thickness using a web thinning caliber for thinning a portion corresponding to slab thickness in a state where the slab is made lateral (a web thinning step), and intermediate universal rolling. Since the flange half-width h at the end of the flange shaping step is at least the product flange half-width H, in the web thinning step using the web thinning caliber, flange width is decreased by the same amount concurrently, and an H-shaped steel product can be produced with flange portions with predetermined dimensions stably shaped. Note that it has been found that the amount of change in web thickness and the amount of decrease in flange width in the web thinning caliber are substantially equal for a large-size H-shaped steel product with a flange width of approximately 1000 mm, for example. Moreover, in intermediate universal rolling, since web thickness and flange width have already been set to values similar to those of a thickness ratio of a product in the web thinning caliber, stretch of the portions is the same, and flange portions can be stably shaped.

Then, the flange width b at the end of the flange shaping step is obtained from the flange half-width h at the end of the flange shaping step, which has been determined so as to satisfy the expression (2), and the slab thickness t at the end of the flange shaping step, by using an expression (3) below.

$$h=(b-t)/2 \tag{3}$$

Then, on the basis of the flange width b at the end of the flange shaping step, which has been obtained by using the expression (3), the split line length L (=L1+L2+L3) of the split 38 formed in shaping using the second caliber K2 is decided. shaping using the first to sixth calibers K1 to K6 is performed under conditions decided in this manner, and particularly the formation of the split 38 in the second caliber K2, is performed in accordance with predetermined conditions; thus, the H-shaped steel product serving as a final product with a desired size (desired dimensions) is stably shaped.

When the split line length L of the split 38 formed using the second caliber K2 is set to a predetermined length by the method described above, an H-shaped steel product having desired dimensions, particularly a flange width larger than a conventional flange width, can be stably produced. That is, shaping of the material to be rolled A is suitably performed without edging rolling, by using a technology completely different from a conventional technology of performing edging rolling on slab end surfaces for spread, and predetermined conditions are employed in the shaping; thus, a flange width with a desired length larger than a conventional length can be achieved, and an H-shaped steel product with a large flange width can be produced.

Moreover, in the present technology, edging rolling on the flange portions of the material to be rolled A is not performed, and the height of the material to be rolled A after the final pass (at a finished stage) of the second caliber K2 is a value obtained by subtracting the amount of a reduction in cross-sectional area caused by creation of the splits 38 and 39, which amount is approximately 2% of the height, for example, and the height of the material to be rolled A is substantially equal to the slab width. In other words, a reduction in cross-sectional area of flanges accompanying stretch of the flange portions in the longitudinal direction can be prevented, and thus an H-shaped steel product can be produced with a large flange width maintained.

In addition, according to a technology according to the present embodiment, even in the case where an H-shaped steel product having the same flange width as a conventional flange width is produced, sufficient cross-sectional area of the flange portions 80 can be ensured at the stage of the rough rolling step; thus, there is no need to perform flange lateral spreading rolling after edging rolling in the rough rolling step, and it is possible to minimize a widening amount in inside-dimension widening rolling of the web portion 89. Description about minimizing an inside-dimension widening amount of the web portion 89 is given below.

Figure 12:
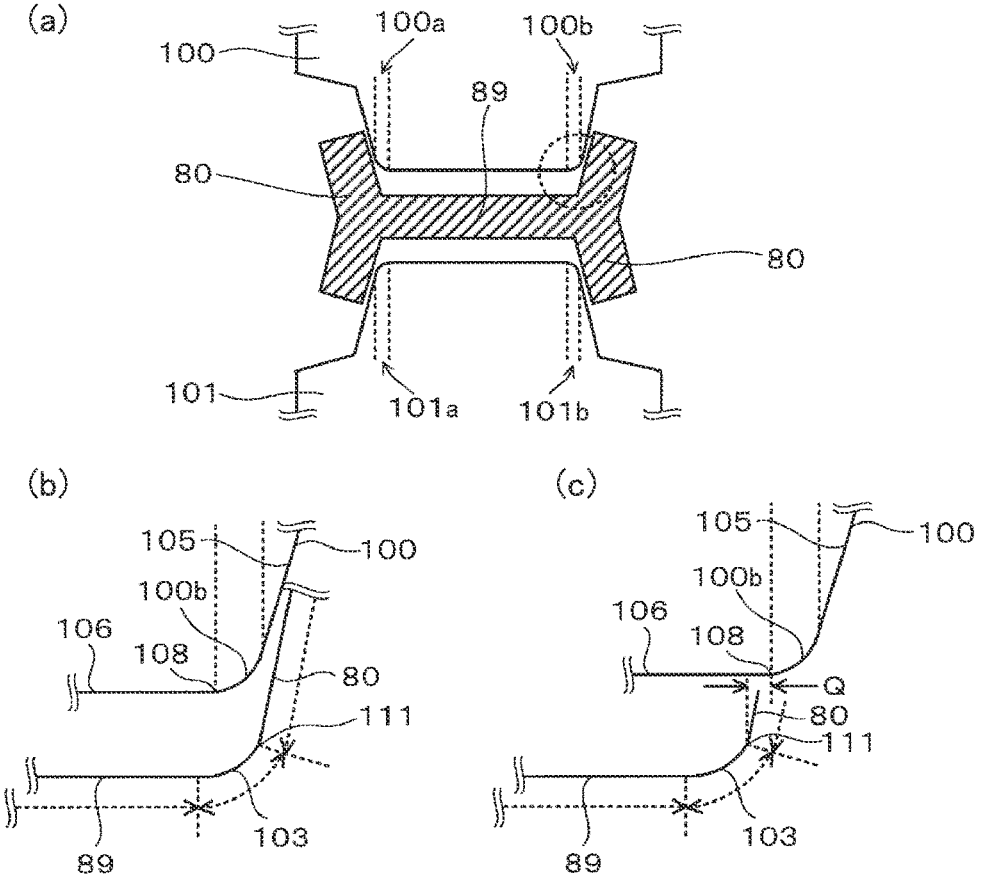
FIG. 12 is a schematic explanatory diagram illustrating an example of a caliber used in performing widening rolling on an inside dimension of a web portion of a material to be rolled.

It is known that, in conventional H-shaped steel production technologies, after web thinning using the seventh caliber K7 is performed, widening rolling for a web inside dimension is performed in a subsequent stage of the rough rolling step and the intermediate rolling step, as described in patent literatures of "JP 2003-10902A" and "JP 2005-88027A", for example. FIG. 12 is a schematic explanatory diagram illustrating an example of a caliber used in performing widening rolling on an inside dimension of the web portion 89 of the material to be rolled A; (a) illustrates an overview of the entire cross-section, and (b) is an enlarged view of part of (a) (the broken-line portion in (a)). As illustrated in FIG. 12(*a*), inside-dimension widening rolling of the web portion 89 is performed by an upper horizontal roll 100 and a lower horizontal roll 101 for widening the inside dimension. Note that inside-dimension widening rolling of the web portion 89 is normally performed by a plurality of rolling mills related to the rough rolling step and the intermediate rolling step (i.e., a rolling mill group subsequent to the web thinning caliber), and inside-dimension widening rolling of the web portion 89 is performed in each rolling mill. The configuration illustrated in FIG. 12 is an illustration of one place of such inside-dimension widening rolling.

For stable inside-dimension widening rolling of the web portion 89, which is performed by the upper horizontal roll 100 and the lower horizontal roll 101 configured as illustrated in FIG. 12(*a*), lengths in the horizontal direction of portions with curvature 100*a* and 100*b* (hereinafter also called corner portions 100*a* and 100*b*) formed at both side end portions of the upper horizontal roll 100 may be set to a widening amount that enables inducting at a web inside surface on one side. Also for the lower horizontal roll 101, similarly, lengths in the horizontal direction of corner portions 101*a* and 101*b* may be set to a widening amount that enables inducting at a web inside surface on one side. Hereinafter, more detailed description will be given on conditions of inside-dimension widening rolling suitably set as such a widening amount that enables inducting, with reference to FIG. 12(*b*).

As illustrated in FIG. 12(*b*), parts of the material to be rolled A are classified in detail into the flange portions 80 and the web portion 89, and curved-line portions 103 connecting them. On the other hand, the upper horizontal roll 100 includes flange-corresponding portions 105 and a web-corresponding portion 106, and corner portions connecting them (the corner portions 100*a* and 100*b* described later). Here, in the case where the boundary point between the web-corresponding portion 106 and the corner portion 100*b* of the upper horizontal roll 100 is referred to as a web-corresponding-portion termination portion 108, and the boundary point between the flange portion 80 and the curved-line portion 103 of the material to be rolled A is referred to as a flange termination portion 111, it is preferable, from the viewpoint of stabilization of centering property and the like, that inside-dimension widening rolling be performed in a state where the web-corresponding-portion termination portion 108 of the upper horizontal roll 100 is present at the inner side (the inner side in the width direction) with respect to the flange termination portion 111 of the material to be rolled A.

FIG. 12(*c*) is an explanatory diagram illustrating the web-corresponding-portion termination portion 108 of the upper horizontal roll 100 is present at the outer side with respect to the flange termination portion 111. In such a case, a distance Q in the horizontal direction (distance in the left-right direction in the drawing) between the web-corresponding-portion termination portion 108 of the upper horizontal roll 100 and the flange termination portion 111 is a length of ½ of an inside-dimension widening amount in widening rolling. In the case where the distance Q in the horizontal direction is a negative value, the inside-dimension widening amount there is handled as zero.

When inside-dimension widening rolling of the web portion 89 is performed in a plurality of rolling mills, a predetermined widening amount may be set to satisfy the conditions described with reference to FIG. 12 in each rolling mill. That is, it is preferable to set conditions such that the sum of widening amounts in the inside-dimension widening rolling step does not exceed the sum of lengths of corner portions (lengths in the horizontal direction of the corner portions) of horizontal rolls provided in the caliber that performs the widening step, and this enables stable web inside-dimension widening rolling. Note that the sum of inside-dimension widening amounts in the web inside-dimension widening rolling that is performed under conditions determined in this manner is referred to as an "inside-dimension widening amount Δ in subsequent mills".

In addition, as described above, according to the technology according to the present embodiment, the flange portions 80 can be shaped efficiently; thus, in terms of dimensional accuracy, the amount of disadvantageous inside-dimension widening of the web portion 89 can be minimized, and moreover, the width of a slab used as a material can be made smaller than a conventional width. Hence, the present inventors carried out extensive studies on a suitable range of slab widths in applying the present invention technology. Description on the suitable range of slab widths is given below.

Figure 13:
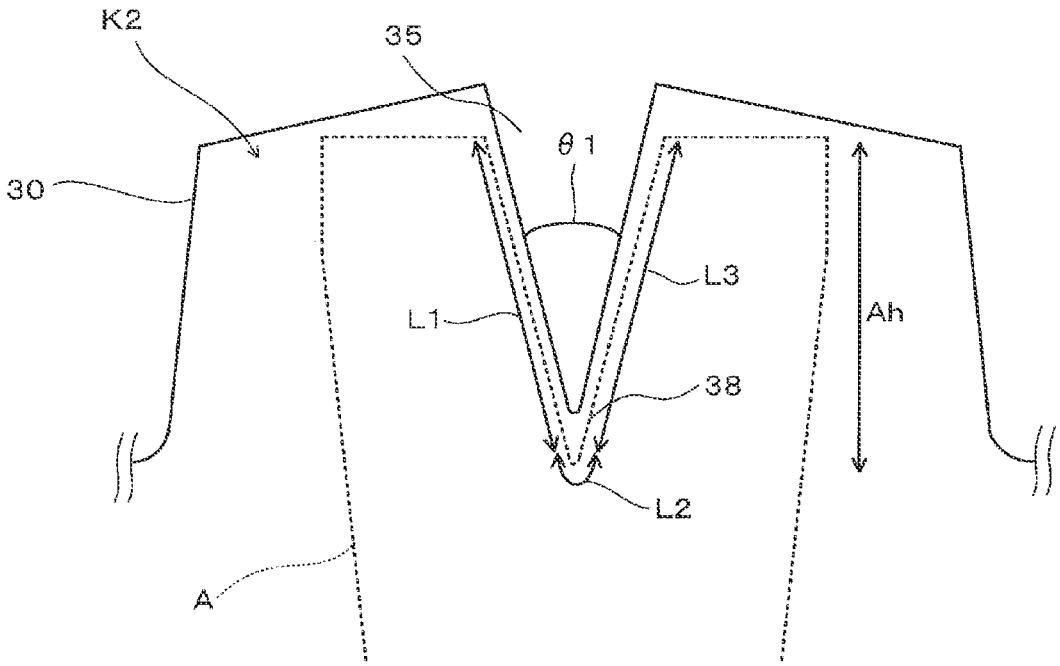
FIG. 13 is a schematic explanatory diagram explaining the manner of shaping in the second caliber, in which part of FIG. 3 is enlarged.
Figure 14:
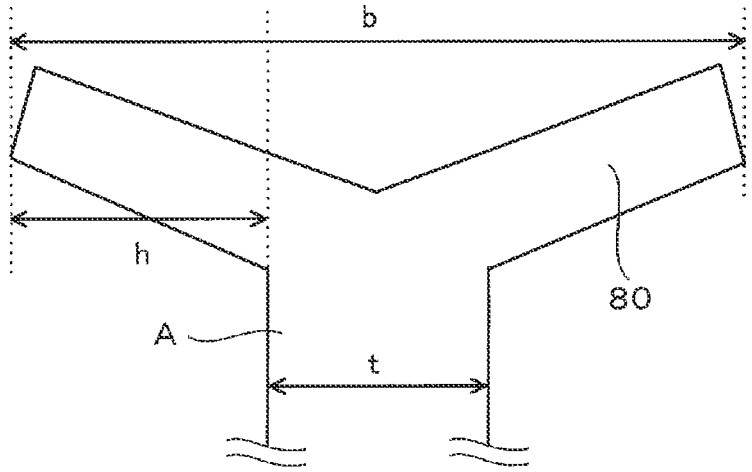
FIG. 14 is an enlarged view of a flange portion of a material to be rolled that has been shaped in the fifth caliber.
Figure 15:
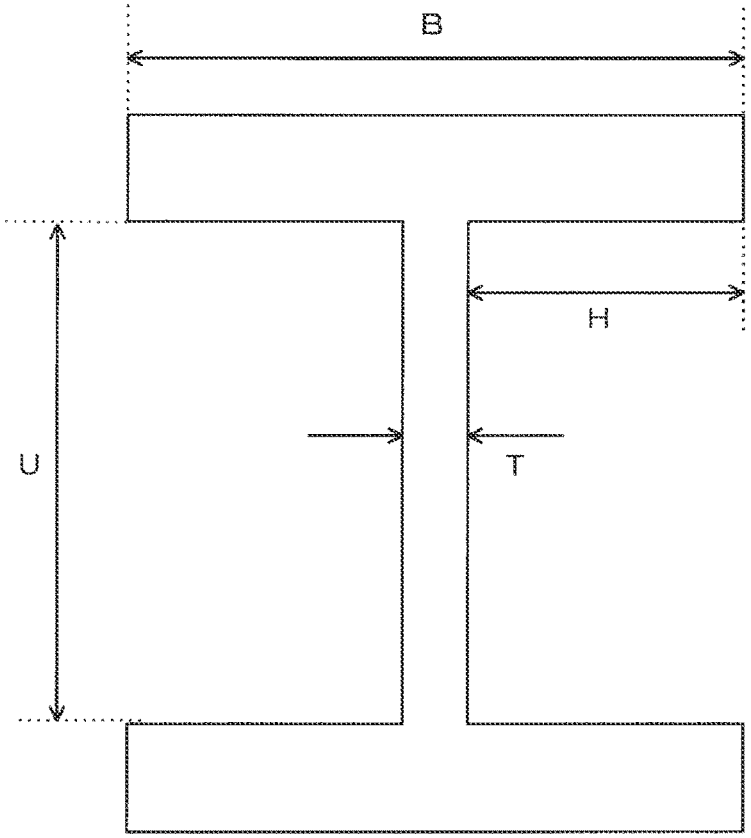
FIG. 15 is an explanatory diagram related to dimensions of H-shaped steel, which is a final product.

First, description is given on various dimensions needed in determining slab width. FIG. 13 is a schematic explanatory diagram explaining the manner of shaping in the second caliber K2, in which part (the upper half) of FIG. 3 is enlarged. Specifically, the upper half of the second caliber K2 illustrated in FIG. 3 is illustrated enlarged. FIG. 14 is an enlarged view of the flange portion 80 of the material to be rolled A that has been shaped in the fifth caliber K5. FIG. 15 is an explanatory diagram related to dimensions of H-shaped steel, which is a final product. Note that structural elements illustrated in FIGS. 13 and 14 are denoted with the same reference numerals as in FIGS. 3 to 7 in some cases.

The split 38 formed in shaping using the second caliber K2 is expanded by shaping using the third to sixth calibers K3 to K6, as described with reference to FIGS. 4 to 7, and finally the flange portion 80 is shaped. Here, a flange width b of the flange portion 80 at the end of shaping using the first to fifth calibers, which is illustrated in FIG. 14, is determined on the basis of the length of a split line length L of the split 38, and similarly, a flange half-width h at the end of shaping using the first to fifth calibers (hereinafter also referred to as the end of edging caliber shaping) is determined on the basis of the value of this split line length L. Note that the slab thickness t is the thickness of a material slab, which is determined in accordance with operation design.

As illustrated in FIG. 13, the split line length L is the sum of lengths L1 and L3 of straight-line portions at side walls on both sides of the split 38 and a curved-line length L2 of a part with curvature at a depth end portion of the split 38. That is, L=L1+L2+L3.

In addition, it is known that a depth Ah of the split 38 (hereinafter also referred to as a wedge height Ah) is determined as expressed in an expression (4) below, by using the split line length L and the split angle θ1 of the split 38.

$$\text{wedge height } Ah=\{\text{split line length } L\times\cos(\theta 1/2)\}/(2\times\alpha) \quad (4)$$

Here, the wedge height Ah is geometrically expressed by the expression (4); a coefficient α, which is a denominator in the expression, is a value determined in consideration of a phenomenon in which, after the split 38 is created in the second caliber K2, the split line length is extended in the third caliber K3 and subsequent calibers, and means that the split line length is extended α fold. The coefficient α changes depending on width and thickness of a slab, the shape of a caliber that performs shaping (e.g., the wedge angle θ1), and the like, and normally falls within a range of 1.1 to 1.3. Note that the average value of this coefficient α is 1.29 when, for example, the wedge angle θ1 is within a range of equal to or more than 25° and equal to or less than 40°.

In addition, as illustrated in FIG. 15, target dimensions of an H-shaped steel product serving as a final product, are prescribed as a product flange width B, a product web thickness T, a product flange half-width H, and a product web inside dimension U. A suitable range of slab widths in applying the present invention technology in this case will be described.

A lower limit value $W_{lower\ limit}$ of a slab width of a slab used as a material (hereinafter, a lower-limit slab width $W_{lower\ limit}$) is determined by an expression (5) below, on the basis of dimensions of an H-shaped steel product described above and dimensions in the rough rolling step.

$$\text{lower-limit slab width } W_{lower\ limit}=(\text{product web inside dimension } U+\text{wedge height } Ah\times 2+\text{slab thickness } t)-\text{inside-dimension widening amount } \Delta \text{ in subsequent mills} \quad (5)$$

On the other hand, an upper limit value $W_{upper\ limit}$ of a slab width of a slab used as a material (hereinafter, an upper-limit slab width $W_{upper\ limit}$) is determined by an expression (6) below.

$$\text{upper-limit slab width } W_{upper\ limit}=\text{slab edging amount}+\text{product web inside dimension } U+\text{inside-dimension widening amount } \Delta \text{ in subsequent mills} \quad (6)$$

Here, the slab edging amount is expressed by a value obtained by subtracting the sum of depths of splits created by the tip portions of the projections 35 and 36 of the second caliber K2 (the intrusion depth h2' illustrated in FIG. 3) from the width of a slab used as a material. That is, the slab edging amount is a value obtained by subtracting 2×h2' from the slab width.

In the case where the width of the slab used as a material exceeds the upper limit value $W_{upper\ limit}$ of the slab width determined in this manner, shape defects may occur (e.g., tip portions of upper and lower end portions of the material to be rolled A (later flange portions 80) may become thicker than the center portion of the material to be rolled A) to cause flaws or the like in subsequent steps.

By deciding the slab width using the value determined in the expression (5) as a lower limit value and the value determined in the expression (6) as an upper limit value as described above, it is possible to produce an H-shaped steel product having the same dimensions as conventional dimensions or having a flange width larger than a conventional flange width by using a slab material with a slab width smaller than a conventional slab width. That is, an H-shaped steel product with a large flange width can be stably produced without an increase in size of a material, for example. Note that specific slab widths will be described later in Examples.

In addition, in producing the H-shaped steel product 16 described above, the formation of the splits 28 and 29 using the projections 25 and 26 in the first caliber K1 illustrated in FIG. 2 and the formation of the splits 38 and 39 using the projections 35 and 36 in the second caliber K2 illustrated in FIG. 3 are preferably performed so as to satisfy predetermined conditions to make cross-sectional area uniform between flange-corresponding portions (flange portions 80) shaped at four places of the material to be rolled A and improve material-passing property in the second caliber K2. Hence, the present inventors carried out extensive studies on conditions that make cross-sectional area uniform between flange-corresponding portions and improve material-passing property in shaping using the second caliber K2 and subsequent calibers (the third to fifth calibers K3 to K5). Description on the studies is given below with reference to drawings.

Figure 21:
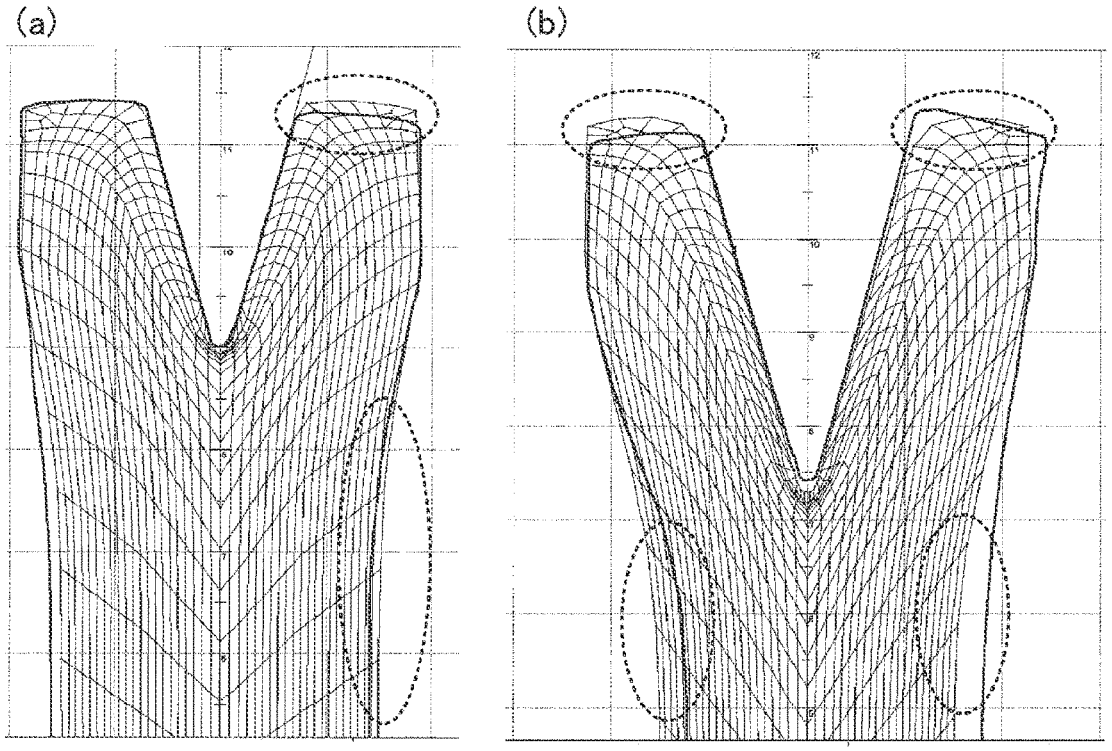
FIG. 21 is a schematic explanatory diagram illustrating an intermediate pass (a) and a final pass (b) in the following case: in the first caliber, grooving is performed on upper and lower end portions of a material to be rolled by using projections with conventionally known dimensions, and after that splits are formed by using the second caliber.

FIG. 21 is a schematic explanatory diagram illustrating an intermediate pass (a) and a final pass (b) in the following case: in the first caliber K1, grooving is performed on the upper and lower end portions of the material to be rolled A (the slab end surfaces) by using projections with conventionally known dimensions, as described in patent literatures of "JP 2062461B" and "JP 2036476B", for example, and after that the splits 38 and 39 are formed by using the second caliber K2 illustrated in FIG. 3. Note that the solid line in FIG. 21 is a schematic diagram of the material to be rolled, and the mesh pattern shows a desired shape of the material to be rolled.

In split formation according to a conventional method, in the intermediate pass in split formation using the second caliber K2, the slab end surface and the slab thickness are ununiform between left and right (see dotted-line portions in the drawing), and the actual shape differs from the desired shape of the material to be rolled, as illustrated in FIG. 21(*a*). Furthermore, at the stage of the final pass after such an intermediate pass, the ununiformity of the slab end surface and the slab thickness between the left and right becomes significant (see dotted-line portions in the drawing), as illustrated in FIG. 21(*b*). Note that the height of the projection in split formation according to the conventional method here is approximately 80 mm, for example.

In view of such problems illustrated in FIG. 21, the present inventors found that there is a problem in split formation using the first caliber according to the conventional method, and also found that particularly for a material to be rolled A with a large slab width, split formation is performed on the skew when the slab is caught in the caliber in a state of being rotated from a desired position. Moreover, in shaping in the second caliber and subsequent calibers, bending shaping proceeds in a state where the left and right of the material to be rolled A are not restrained, as is apparent from FIGS. 3 to 6; thus, shaping proceeds without the problems illustrated in FIG. 21 being corrected.

Here, in a conventional technology, the slab end surface and the slab thickness are already ununiform between the left and right in the intermediate pass of the second caliber K2, as illustrated in FIG. 21(*a*); in view of this fact, the present inventors carried out extensive studies on shaping in the first caliber K1, which is a preceding caliber, and found that it is effective to make the height of the projections 25 and 26 (hereinafter also referred to as a wedge height) in the first caliber K1 larger than a conventional height to improve inductivity for the material to be rolled A in subsequent calibers (the second caliber K2 and subsequent calibers). Moreover, it was found that in increasing the wedge height in the first caliber K1, it is preferable to set a height that satisfies a predetermined condition. Description on this finding is given below.

The present inventors carried out studies on a case where shaping of H-shaped steel is performed by using three types of slabs having a slab thickness of 300 mm and a slab width of 2300 mm, a slab thickness of 300 mm and a slab width of 1800 mm, a slab thickness of 250 mm and a slab width of 1200 mm, as a material slab serving as the material to be rolled A. Specifically, in a shaping process using the five calibers described with reference to FIGS. 2 to 6, the wedge height of the first caliber K1 was fluctuated, and thickness variations of left and right flange-corresponding portions after rolling using the fourth caliber K4 were measured.

Figure 22:
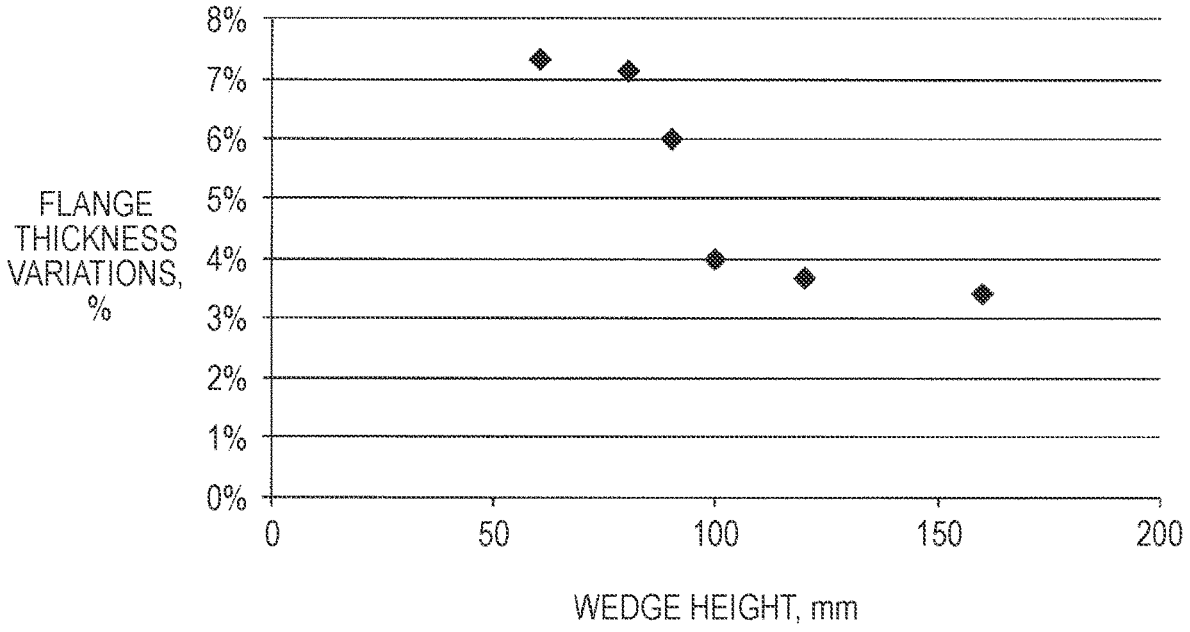
FIG. 22 is a graph showing the relation between a wedge height of the first caliber and thickness variations of left and right flange-corresponding portions after rolling using the fourth caliber when a slab with a thickness of 300 mm and a width of 2300 mm is used as a material.

FIG. 22 is a graph showing the relation between the wedge height of the first caliber K1 and thickness variations of left and right flange-corresponding portions (flange thickness variations) after rolling using the fourth caliber K4 when the slab with a thickness of 300 mm and a width of 2300 mm was used as a material. Here, flange thickness variations, the vertical axis of the graph in FIG. 22, indicate variations 3σ from the average flange thickness of four flange-corresponding portions shaped by expanding splits.

FIG. 22 shows that in the case where the wedge height of the first caliber K1 was set to 100 mm or more, flange thickness variations were greatly decreased. That is, it is shown that in the case where shaping of H-shaped steel according to the present embodiment is performed with the slab with a thickness of 300 mm and a width of 2300 mm used as a material, setting the wedge height of the first caliber K1 to 100 mm or more decreases flange thickness variations in subsequent shaping.

Thickness variations of left and right flange-corresponding portions are preferably suppressed to 5% or less. According to JIS standard (JIS G 3192), an allowance of shape dimensions of large-size H-shaped steel is as follows: in the case where a flange thickness exceeds 40 mm, tolerance of the flange thickness is 4 mm (i.e., ±2 mm), which corresponds to 10% of a flange thickness of a product. In the case where flange dimensions of a product are out of the tolerance, correction by working is difficult, and the product is not recognized as a product with predetermined quality, which is problematic in terms of production efficiency and cost. Accordingly, it is necessary to ensure sufficient process capability in each shaping step and suppress thickness variations of left and right flange-corresponding portions in producing an H-shaped steel product. Normally, it is preferable to set tolerance of a flange thickness to 6σ to ensure sufficient process capability in each shaping step. To match 10% of a flange thickness of an H-shaped steel product with 6σ on the basis of the JIS standard, it is preferable to set the target value of thickness variations 3σ of left and right flange-corresponding portions to 5% or less.

Figure 23:
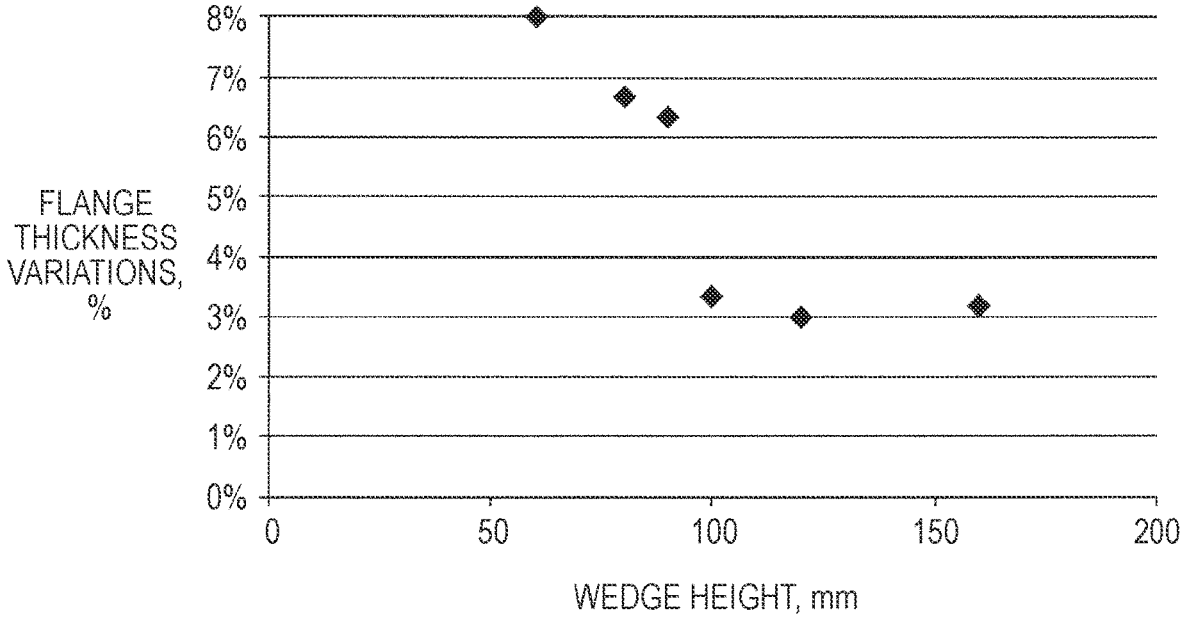
FIG. 23 is a graph showing the relation between a wedge height of the first caliber and thickness variations of left and right flange-corresponding portions after rolling using the fourth caliber when a slab with a thickness of 300 mm and a width of 1800 mm is used as a material.

FIG. 23 is a graph showing the relation between the wedge height of the first caliber K1 and thickness variations of left and right flange-corresponding portions (flange thickness variations) after rolling using the fourth caliber K4 when the slab with a thickness of 300 mm and a width of 1800 mm was used as a material. FIG. 23 shows that in the case where the wedge height of the first caliber K1 was set to 100 mm or more, flange thickness variations were greatly decreased to be 5% or less. That is, it is shown that in the case where shaping of H-shaped steel according to the present embodiment is performed with the slab with a thickness of 300 mm and a width of 1800 mm used as a material, setting the wedge height of the first caliber K1 to 100 mm or more decreases flange thickness variations in subsequent shaping.

Figure 24:
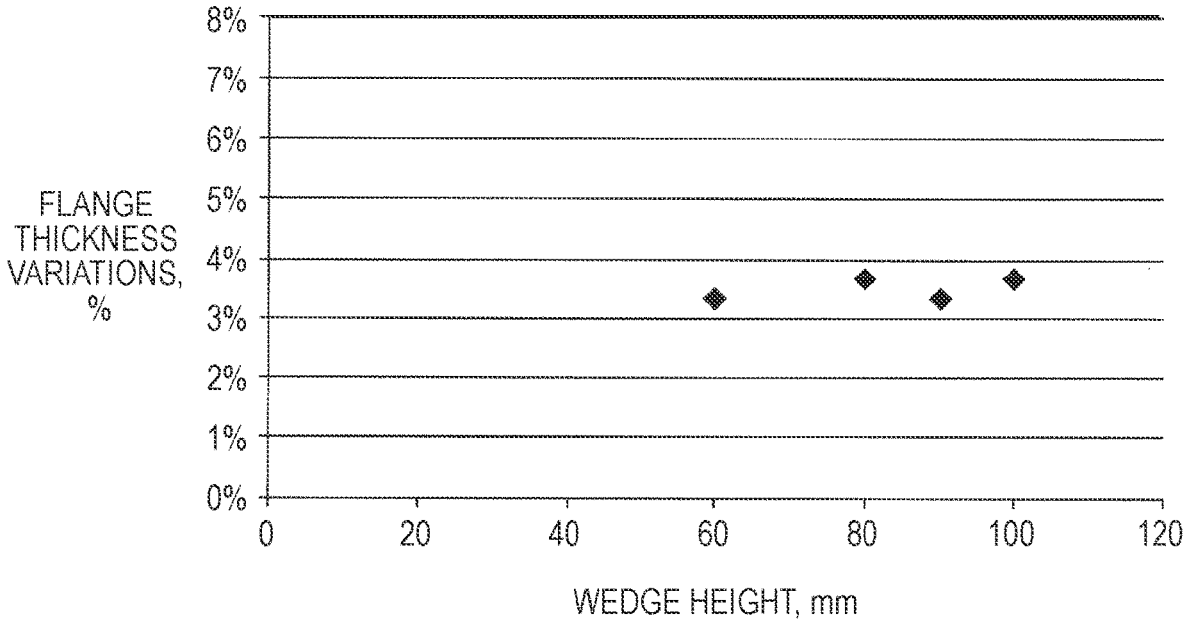
FIG. 24 is a graph showing the relation between a wedge height of the first caliber and thickness variations of left and right flange-corresponding portions after rolling using the fourth caliber when a slab with a thickness of 250 mm and a width of 1200 mm is used as a material.

FIG. 24 is a graph showing the relation between the wedge height of the first caliber K1 and thickness variations of left and right flange-corresponding portions (flange thickness variations) after rolling using the fourth caliber K4 when the slab with a thickness of 250 mm and a width of 1200 mm was used as a material. FIG. 24 shows that in each case where the wedge height of the first caliber K1 was set to 60 mm or more, flange thickness variations were 5% or less. That is, it is shown that in the case where shaping of H-shaped steel according to the present embodiment is performed with the slab with a thickness of 250 mm and a width of 1200 mm used as a material, setting the wedge height of the first caliber K1 to 60 mm or more decreases flange thickness variations in subsequent shaping.

As shown by the above finding, in the case where shaping of H-shaped steel according to the present embodiment is performed with a slab with predetermined dimensions used as a material, setting the wedge height of the first caliber K1 to a predetermined height or more decreases flange thickness variations in subsequent shaping, making thickness variations of left and right flange-corresponding portions after rolling using the fourth caliber K4 equal to or less than 5%, for example.

According to studies by the present inventors, it has been found that a ratio between width and thickness of a material slab (=slab width/slab thickness) is related to flange thickness variations in shaping. That is, the ratio of slab width/slab thickness of the material slab has been found to be associated with ease of rotation of the material to be rolled in the caliber; for example, larger slab width/slab thickness makes rotation easier and smaller slab width/slab thickness makes rotation more difficult. Values of slab width/slab thickness in the cases shown in FIGS. 22 to 24 are 7.7, 6.0, and 4.8, respectively.

In the case where slab width/slab thickness is small as shown in FIG. 24, rotation of the material to be rolled is suppressed and rolling is stabilized; consequently, flange thickness variations in shaping are less likely to occur. That is, even if the wedge height of the first caliber K1 is small to some degree, significant flange thickness variations in shaping do not occur.

On the other hand, in the case where slab width/slab thickness is large as shown in FIGS. 22 and 23, setting the wedge height of the first caliber K1 to a height larger than a predetermined condition suppresses rotation of the material to be rolled, decreasing flange thickness variations in shaping.

As shown in FIGS. 22 to 24, it has been found that in each case where the wedge height of the first caliber K1 is set to 100 mm or more, flange thickness variations in subsequent shaping can be decreased. In particular, FIGS. 22 and 23 show that in the case where slab width/slab thickness of the material slab is equal to or more than 6.0 and equal to or less than 7.7, setting the wedge height of the first caliber K1 to 100 mm or more suppresses thickness variations of left and right flange-corresponding portions after rolling using the fourth caliber K4 to 5% or less. These facts show that when slab width/slab thickness of the material slab is equal to or more than 6.0 and equal to or less than 7.7, setting the wedge height of the first caliber K1 to 100 mm or more decreases flange thickness variations in subsequent shaping, making thickness variations of left and right flange-corresponding portions after rolling using the fourth caliber K4 equal to or less than 5%, for example.

As described above, when a slab with predetermined dimensions is used as a material and the wedge height of the first caliber K1 is set to a height larger than a conventional height to fall within a suitable range, in shaping of the material to be rolled A using subsequent calibers (e.g., the second caliber K2, the third caliber K3, and the fourth caliber K4), a difference in cross-sectional area between left and right flange-corresponding portions can be decreased, leading to a decrease in thickness variations, and material-passing property can be improved. This improves dimensional accuracy of an H-shaped steel product after shaping.

The embodiment(s) of the present invention has/have been described above, whilst the present invention is not limited to the illustrated examples. A person skilled in the art may find various alterations and modifications within the scope of the appended claims, and it should be understood that they will naturally come under the technical scope of the present invention.

For example, in the above embodiment, description is given assuming that the seven calibers of the first to seventh calibers K1 to K7 are engraved to perform shaping of the material to be rolled A, but the present invention is not limited to this. That is, the number of calibers engraved in the sizing mill 3 and the rough rolling mill 4 can be changed arbitrarily, and is changed as appropriate to the extent that the rough rolling step can be performed suitably.

In the rough rolling step for production of an H-shaped steel product, it is not necessary to use all of the first to sixth calibers K1 to K6 described in the above embodiment. For example, depending on a desired shape of an H-shaped raw blank, it is possible to use only the first to fifth calibers K1 to K5, and perform a rough rolling step such that the flange portions 80 with substantially flat shapes described in the above embodiment are not shaped.

Tip-portion shapes of the projections in the caliber roll shapes illustrated and described in the above embodiment (the tip portions with wedge angles θ1 to θ4 illustrated in FIGS. 2 to 6) are designed arbitrarily. That is, corner-portion curvatures (R) at the tip portions are preferably in a range of R: approximately 10 mm to 30 mm, which is normally provided in roll designing.

In addition, although the above embodiment describes that it is preferable that active reduction not be performed on the material to be rolled A in the first to fifth calibers K1 to K5, this does not negate a case where part of the material to be rolled A comes into contact with the caliber to be subjected to reduction, depending on the relation between the shape of the caliber and the shape of the material to be rolled, for example. It is preferable that slab end surfaces be out of contact with the caliber from the following viewpoint: reduction in the calibers K1 to K5 causes stretch of the material to be rolled A in the longitudinal direction, which decreases efficiency in generating flange portions. However, in caliber shaping, asymmetrical deformation or the like of a cross-section of the material to be rolled A occurs in a shaping process in some cases, and a phenomenon is generally observed in which the asymmetrical deformation or the like causes part or the whole of the material to be rolled A come into contact with the caliber. Such reduction that is generally observed in caliber shaping is within the scope of the technology of not performing active reduction, which is described in the above embodiment.

The material (material to be rolled A) in producing the H-shaped steel is described to be a slab, for example, but the present invention is also applicable to other materials. That is, the present invention can also be applied to a case where a beam blank material is shaped to produce H-shaped steel.

EXAMPLES

As Example 1 according to the present invention, a specific example in which the present invention technology is applied to an actual rough rolling step of H-shaped steel will be described. In the present example, description is given on a case where rough rolling was performed by using the first to sixth calibers described in the above embodiment.

Example 1

First, in the first caliber, splits were created on a slab material with a cross-section of width 2300 mm×thickness 300 mm. Here, the caliber width of the first caliber was set to about 300 mm, and reduction was not performed. The wedge angle was set to 30°.

Then, in the second caliber, deep splits with a depth of 390 mm were formed with the same wedge angle 30° as that of the first caliber. After that, a material to be rolled was shaped in the third to sixth calibers as described in the above embodiment. Here, the wedge angle of the projections in each caliber was set as follows: the third caliber: 60°, the fourth caliber: 90°, the fifth caliber: 120°, and the sixth caliber: 180° (flat).

In such shaping, the split line length in each caliber was as follows: the second caliber: 870 mm, the third caliber: 900 mm, the fourth caliber: 974 mm, the fifth caliber: 1028 mm, and the sixth caliber: 1123 mm. The flange width was 1123 mm after shaping using the sixth caliber, which is the final caliber, and the flange half-width of the material to be rolled at this stage was 412 mm.

On the other hand, in the case where an H-shaped steel product having dimensions of a product flange width of 850 mm, which flange width is larger than a conventional flange width, is produced, when the product web thickness is set to 26 mm, the flange half-width is 412 mm. This shows that using the material to be rolled with a flange half-width of 412 mm produced under the conditions described above makes it possible to produce an H-shaped steel product with a product flange width as large as 850 mm.

In addition, as Examples 2 and 3 according to the present invention, studies were carried out on a suitable slab width of a material slab in producing an H-shaped steel product with a predetermined flange width, and appropriate slab widths were calculated for the case where the present invention technology is applied and the case where a conventional method is used.

Example 2

Assuming a case of using material slabs with a slab thickness of 300 mm to produce H-shaped steel products with web heights of 1050 mm to 1650 mm, a flange width of 650 mm, a web thickness of 19 mm, and a flange thickness of 31 mm, appropriate slab widths when the conventional method is used for production (Comparative Example) and appropriate slab widths when the present invention technology is applied for production (Example) were calculated. For the calculation of the slab widths when the present invention technology is applied, lower limit values were calculated by using the expression (5) described in the above embodiment, assuming that the wedge angle is 30° and the web inside-dimension widening amount after web thinning is 360 mm.

Table 1 is a table showing calculation results of Example 2 (the present invention), and shows a product web height (simply referred to as web height in the table), a product flange width (simply referred to as flange width in the table), and a slab thickness and a slab width of the material used, in each case. Note that units in the tables below are all mm.

TABLE 1

Present invention unit: mm

| Web height | Flange width | Slab thickness | Slab width |
|---|---|---|---|
| 1.050 | 650 | 300 | 2.050 |
| 1.150 | 650 | 300 | 2.150 |
| 1.250 | 650 | 300 | 2.250 |
| 1.350 | 650 | 300 | 2.350 |
| 1.450 | 650 | 300 | 2.450 |
| 1.550 | 650 | 300 | 2.550 |
| 1.650 | 650 | 300 | 2.650 |

Table 2 is a table showing calculation results of Comparative Example (the conventional method), and shows a product web height, a product flange width, and a slab thickness and a slab width of the material used, in each case.

TABLE 2

Conventional method

| Web height | Flange width | Slab thickness | Slab width |
|---|---|---|---|
| 1.050 | 650 | 300 | 2.200 |
| 1.150 | 650 | 300 | 2.300 |
| 1.250 | 650 | 300 | 2.400 |
| 1.350 | 650 | 300 | 2.500 |
| 1.450 | 650 | 300 | 2.600 |
| 1.550 | 650 | 300 | 2.700 |
| 1.650 | 650 | 300 | 2.800 |

According to comparison between Table 1 and Table 2, in each case of producing H-shaped steel products with sizes of web heights of 1050 mm to 1650 mm, the slab width of the material slab used in Example (i.e., when the present invention technology is applied) is smaller than the slab width of the material slab used in Comparative Example (i.e., when the conventional method is used). These results show that applying the present invention technology makes it possible to produce an H-shaped steel product with the same size as a conventional size from a material slab with smaller dimensions, and demonstrates that an H-shaped steel product with the same dimensions as conventional dimensions can be produced at low cost without an increase in material size.

Example 3

Assuming a case of using material slabs with a slab thickness of 300 mm to produce H-shaped steel products with web heights of 1050 mm to 1650 mm, flange widths of 350 mm to 650 mm, a web thickness of 20 mm, and a flange thickness of 50 mm, studies were carried out, as Example 3, on a range of sizes of H-shaped steel products produced when the present invention technology is applied.

Figure 16:
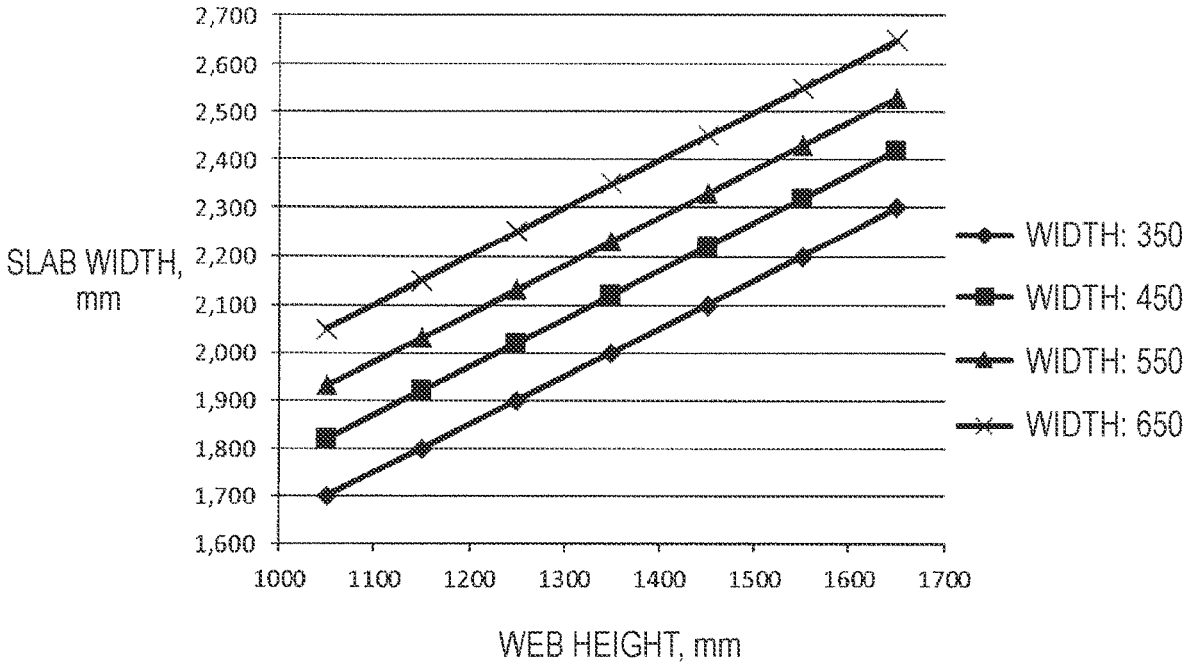
FIG. 16 is a graph showing study results of Example 3.
Figure 17:
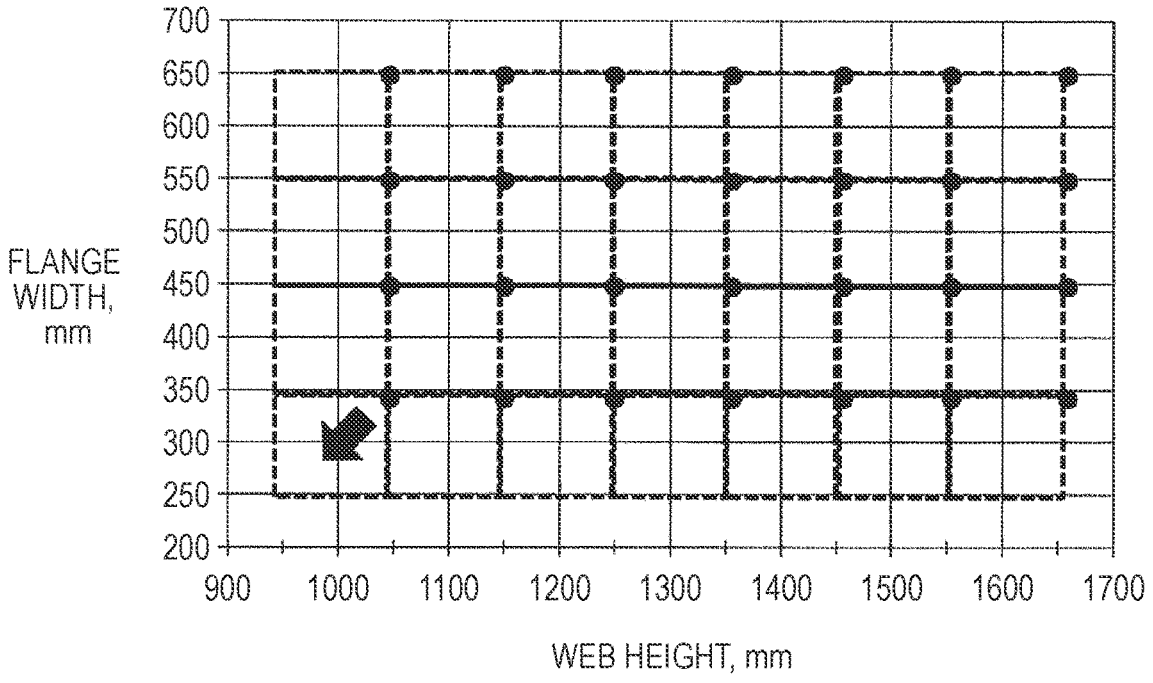
FIG. 17 is a graph in which, in regard to the study results of Example 3, a flange width and a web height of a produced H-shaped steel product are grouped and plotted.

FIG. 16 is a graph showing study results of Example 3, and shows the relation between a web height of an H-shaped steel product and a slab width of a material for H-shaped steel products with flange widths of 350 mm, 450 mm, 550 mm, and 650 mm. FIG. 17 is a graph in which, in regard to the study results of Example 3, the flange width and the web height of the produced H-shaped steel product are grouped and plotted, and shows an example of a feasible range of the present invention.

In production of an H-shaped steel product, normally, a flange width of a material to be rolled can be controlled within a range of approximately 100 mm in rolling shaping using an intermediate universal rolling mill and an edger rolling mill, which are positioned subsequent to a rough rolling mill. Moreover, a technology of widening or decreasing a web inside dimension of a material to be rolled in the rough rolling mill and the intermediate universal rolling mill is known, and using such a technology makes it possible to produce H-shaped steel products with dimensions within the range indicated by the broken line in FIG. 17 by application of the present invention.

INDUSTRIAL APPLICABILITY

The present invention can be applied to a method for producing H-shaped steel using a slab or the like having a rectangular cross-section as a material, for example.

The invention claimed is:

1. A method for producing H-shaped steel using a slab as a material, the method comprising:

a rough rolling step;

an intermediate rolling step; and a finish rolling step, wherein in a rolling mill that performs the rough rolling step, a plurality of calibers to shape a material to be rolled, and a web thinning caliber to thin a web of the material to be rolled that has been shaped in the plurality of calibers are engraved, the number of the plurality of calibers being three or more, shaping of a plurality of passes is performed on the material to be rolled in part or all of the plurality of calibers, in a first caliber and a second caliber among the plurality of calibers, projections to create splits vertically with respect to a width direction of the material to be rolled are formed, in a third caliber and subsequent calibers among the plurality of calibers, a step of sequentially bending divided parts formed by the splits is performed, and the projections formed in the first caliber and the second caliber have a tip angle of 40° or less.

2. The method for producing H-shaped steel according to claim 1, wherein a slab width of the slab is larger than a lower-limit slab width determined by an expression (5) below and is smaller than an upper-limit slab width determined by an expression (6) below:

lower-limit slab width=(product web inside dimension $U$+wedge height $Ah$×2+slab thickness $t$)−inside-dimension widening amount Δ in subsequent mills, Expression (5):

upper-limit slab width=slab edging amount+product web inside dimension $U$+inside-dimension widening amount Δ in subsequent mills, Expression (6):

where subsequent mills refer to a group of a series of rolling mills that are subsequent to the web thinning caliber and perform widening of a web inside dimension.

3. The method for producing H-shaped steel according to claim 1, wherein shaping in the plurality of calibers is performed under a condition that satisfies an expression (2) below, where h denotes a flange half-width at the end of caliber shaping, and H denotes a flange half-width of an H-shaped steel product:

$h \geq H$. Expression (2):

4. The method for producing H-shaped steel according to claim 1, wherein in the first caliber among the plurality of calibers, a caliber width of the caliber is substantially equal to a thickness of the material to be rolled in shaping using the caliber.

5. The method for producing H-shaped steel according to claim 1, wherein in the second caliber among the plurality of calibers, shaping is performed in a state where an end surface of the material to be rolled is out of contact with a bottom surface of the caliber.

6. The method for producing H-shaped steel according to claim 1, wherein in the plurality of calibers, shaping is performed in a state where an end surface of the material to be rolled is out of contact with a bottom surface of the caliber.

7. The method for producing H-shaped steel according to claim 1, wherein the projections have a tip angle of equal to or more than 25° and equal to or less than 35°.

8. The method for producing H-shaped steel according to claim 1, wherein the slab is a slab material whose slab width/slab thickness is equal to or more than 6.0 and equal to or less than 7.7, and the projections formed in the first caliber are designed to have a height of 100 mm or more.

9. The method for producing H-shaped steel according to claim 1, wherein the plurality of calibers are engraved in a sizing mill.

10. The method for producing H-shaped steel according to claim 1, wherein projections that are pressed against the divided parts to bend the divided parts are formed in the third caliber and subsequent calibers among the plurality of calibers, and the projections formed in the second caliber and subsequent calibers have tip angles sequentially increasing toward subsequent calibers.

11. The method for producing H-shaped steel according to claim 1, wherein a slab width of the slab is larger than a lower-limit slab width determined by an expression (5) below and is smaller than an upper-limit slab width determined by an expression (6) below:

lower-limit slab width=(product web inside dimension $U$+wedge height $Ah$×2+slab thickness $t$)−inside-dimension widening amount Δ in subsequent mills, Expression (5):

upper-limit slab width=slab edging amount+product web inside dimension $U$+inside-dimension widening amount Δ in subsequent mills, Expression (6):

where subsequent mills refer to a group of a series of rolling mills that are subsequent to the web thinning caliber and perform widening of a web inside dimension, and in the first caliber among the plurality of calibers, a caliber width of the caliber is substantially equal to a thickness of the material to be rolled in shaping using the caliber.

12. The method for producing H-shaped steel according to claim 1, wherein a slab width of the slab is larger than a lower-limit slab width determined by an expression (5) below and is smaller than an upper-limit slab width determined by an expression (6) below:

lower-limit slab width=(product web inside dimension $U$+wedge height $Ah$×2+slab thickness $t$)−inside-dimension widening amount Δ in subsequent mills, Expression (5):

upper-limit slab width=slab edging amount+product web inside dimension $U$+inside-dimension widening amount Δ in subsequent mills, Expression (6):

where subsequent mills refer to a group of a series of rolling mills that are subsequent to the web thinning caliber and perform widening of a web inside dimension, and the projections have a tip angle of equal to or more than 25° and equal to or less than 35°.

13. The method for producing H-shaped steel according to claim 1, wherein a slab width of the slab is larger than a lower-limit slab width determined by an expression (5) below and is smaller than an upper-limit slab width determined by an expression (6) below:

lower-limit slab width=(product web inside dimension $U$+wedge height $Ah$×2+slab thickness $t$)−inside-dimension widening amount Δ in subsequent mills, Expression (5):

upper-limit slab width=slab edging amount+product web inside dimension $U$+inside-dimension widening amount Δ in subsequent mills, Expression (6):

where subsequent mills refer to a group of a series of rolling mills that are subsequent to the web thinning caliber and perform widening of a web inside dimension, in the first caliber among the plurality of calibers, a caliber width of the caliber is substantially equal to a thickness of the material to be rolled in shaping using the caliber, and the projections have a tip angle of equal to or more than 25° and equal to or less than 35°.

* * * * *